US008191994B2

(12) United States Patent
Nakakubo et al.

(10) Patent No.: US 8,191,994 B2
(45) Date of Patent: Jun. 5, 2012

(54) LIQUID EJECTION HEAD UTILIZING DEFLECTION MEMBERS

(75) Inventors: Toru Nakakubo, Kawasaki (JP); Takahisa Kato, Tokyo (JP); Haruhito Ono, Minamiashigara (JP); Suguru Miyagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/079,418

(22) Filed: Apr. 4, 2011

(65) Prior Publication Data

US 2011/0249063 A1 Oct. 13, 2011

(30) Foreign Application Priority Data

Apr. 13, 2010 (JP) ..... 2010-092088

(51) Int. Cl.
*B41J 2/04* (2006.01)

(52) U.S. Cl. ..... 347/54; 347/76; 347/77

(58) Field of Classification Search ..... 347/20, 347/54, 55, 73–77
See application file for complete search history.

(56) References Cited

U.S. PATENT DOCUMENTS 4,223,320 A * 9/1980 Paranjpe et al. ..... 347/76
5,394,180 A 2/1995 Soucemarianadin et al.

FOREIGN PATENT DOCUMENTS

JP 3260416 B2 2/2002

* cited by examiner

*Primary Examiner* — Juanita D Jackson
(74) *Attorney, Agent, or Firm* — Fitzpatrick, Cella, Harper & Scinto

(57) ABSTRACT

Provided is a continuous-type charge deflection liquid ejection head that is suitable for higher-density and multiple nozzles. This liquid ejection head includes: an orifice plate having a plurality of nozzles arranged in a two-dimensional manner; a charging electrode plate having a charging electrode to charge ink droplets from each of the plurality of nozzles; and first and second deflection electrode plates each having a deflection electrode to deflect each of the ink droplets charged by the charging electrode, in which each of the charging member, the first deflection member, and the second deflection member has through-holes that ink droplets pass through, and the charging member, the first deflection member, and the second deflection member are laminated in this order in an ejecting direction of the ink droplets.

7 Claims, 24 Drawing Sheets

LIQUID EJECTION HEAD UTILIZING DEFLECTION MEMBERS

BACKGROUND OF THE INVENTION

1. Field of the Invention

The present invention relates to a liquid ejection head used for a continuous-type liquid ejection device.

2. Description of the Related Art

In a continuous-type inkjet device (liquid ejection device), a pump constantly applies pressure on ink to push out the ink, and a vibration excitation means applies vibration on the pushed-out ink to make an ink droplet forming state called Rayleigh jet, whereby ink droplets are regularly ejected from a nozzle. In such a continuous-type inkjet device, since ink is constantly being ejected from a nozzle, ink droplets to be used for printing or ink droplets not to be used for printing need to be selected depending on print data. In order to do so, ink droplets are selectively charged and deflected by an electric field to thereby make the charged ink droplets fly along a trajectory different from that of uncharged ink droplets. In a continuous-type inkjet device called a binary type, uncharged ink droplets are used for printing, and charged ink droplets are caught and recovered by a gutter.

As the continuous-type inkjet device, a continuous-type inkjet device with a plurality of nozzles linearly arranged is known in order to obtain a highly fine image. Japanese Patent Publication No. 3260416 discloses a modular multi jet deflection head having a plurality of nozzles arranged in one line. In a deflection electrode described in Japanese Patent Publication No. 3260416, members in which wiring is formed by patterning are respectively provided to both of upper and lower surfaces of an electrode plate, and one pole is drawn out onto the upper surface of the electrode, whereas the other pole is drawn out onto the lower surface of the electrode, whereby the assembled deflection electrode has a structure in which the two types of poles are alternately arranged in the electrode plate.

Meanwhile, in order to realize the speed-up of printing and a highly fine print image, it is effective to increase the number of nuzzles and arrange the nozzles densely in a two-dimensional array. Japanese Patent Publication No. 3260416 discloses that in order to obtain high resolution, in making a two-dimensional array, a plurality of modules are provided and combined on their side surfaces.

However, assembling of the modules requires high accuracy, and also as the number of nozzle arrays is increased, the number of man-hours for assembling increases, which causes an increase in production cost.

SUMMARY OF THE INVENTION

An objective of the present invention is to provide a continuous-type liquid ejection head that realizes high resolution and low production cost.

A liquid ejection head according to the present invention includes: a nozzle member having a plurality of nozzles to eject ink droplets, the plurality of nozzles being arranged in a two dimensional manner along a first direction and a second direction different from the first direction; a charging member having a charging electrode to charge ink droplets ejected from each of the plurality of nozzles; and a first deflection member and a second deflection member, each having a deflection electrode to deflect each of the ink droplets charged by the charging electrode, wherein each of the charging member, the first deflection member, and the second deflection member has through-holes that the ink droplets ejected from the plurality of nozzles pass through, and the charging member, the first deflection member, and the second deflection member are laminated (stacked) in this order in an ejecting direction of ink droplets from each of the plurality of nozzles.

According to the present invention, provided is a high-speed and highly fine liquid ejection head, and also a liquid ejection head that prevents the number of components from increasing even if the number of nozzle arrays is increased, which leads to low production cost.

Further features of the present invention will become apparent from the following description of exemplary embodiments (with reference to the attached drawings).

DESCRIPTION OF THE EMBODIMENTS

First Embodiment

A first embodiment of the present invention will be described. In this embodiment, an inkjet printer will be described. However, the present invention is not limited to the case where a printing ink using a color material is ejected, but can be applied to ejection of other general liquids.

Figure 1:
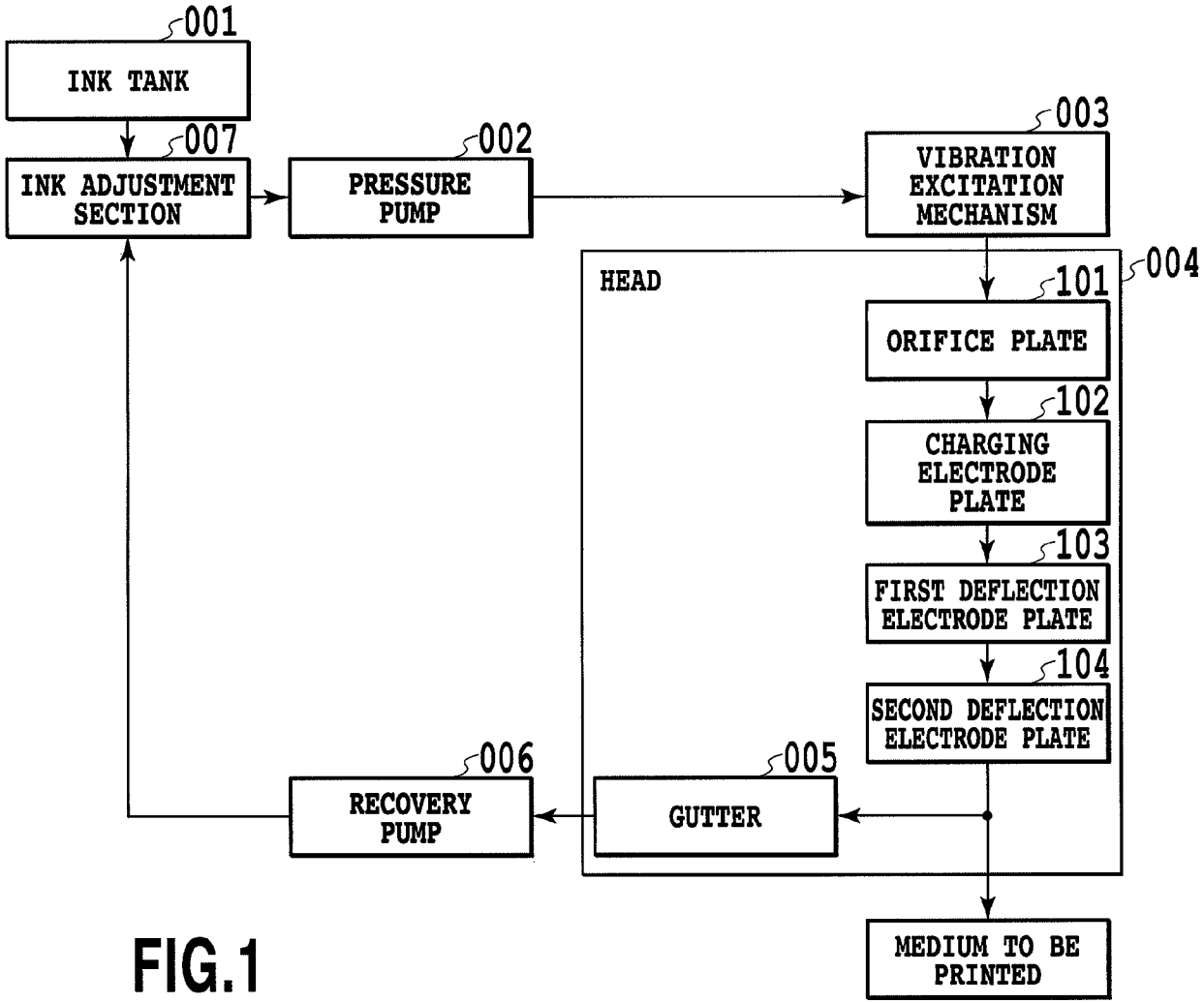
FIG. 1 is a system schematic diagram of one example of an inkjet device to which the present invention is applied.
Figure 2B:
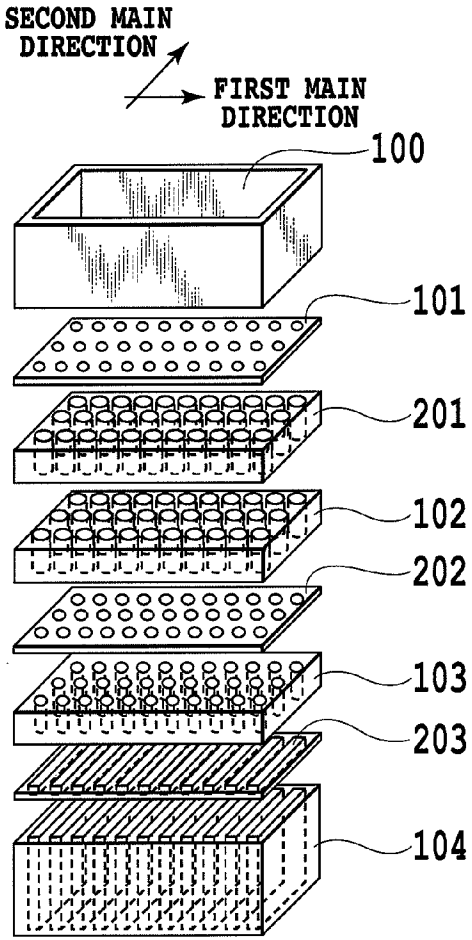
FIGS. 2A and 2B are a perspective view and an exploded perspective view of an inkjet head according to one embodiment of the present invention.
Figure 2A:
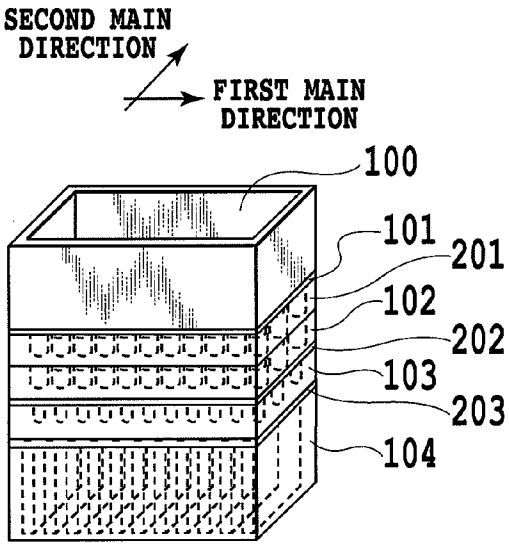
Figure 3:
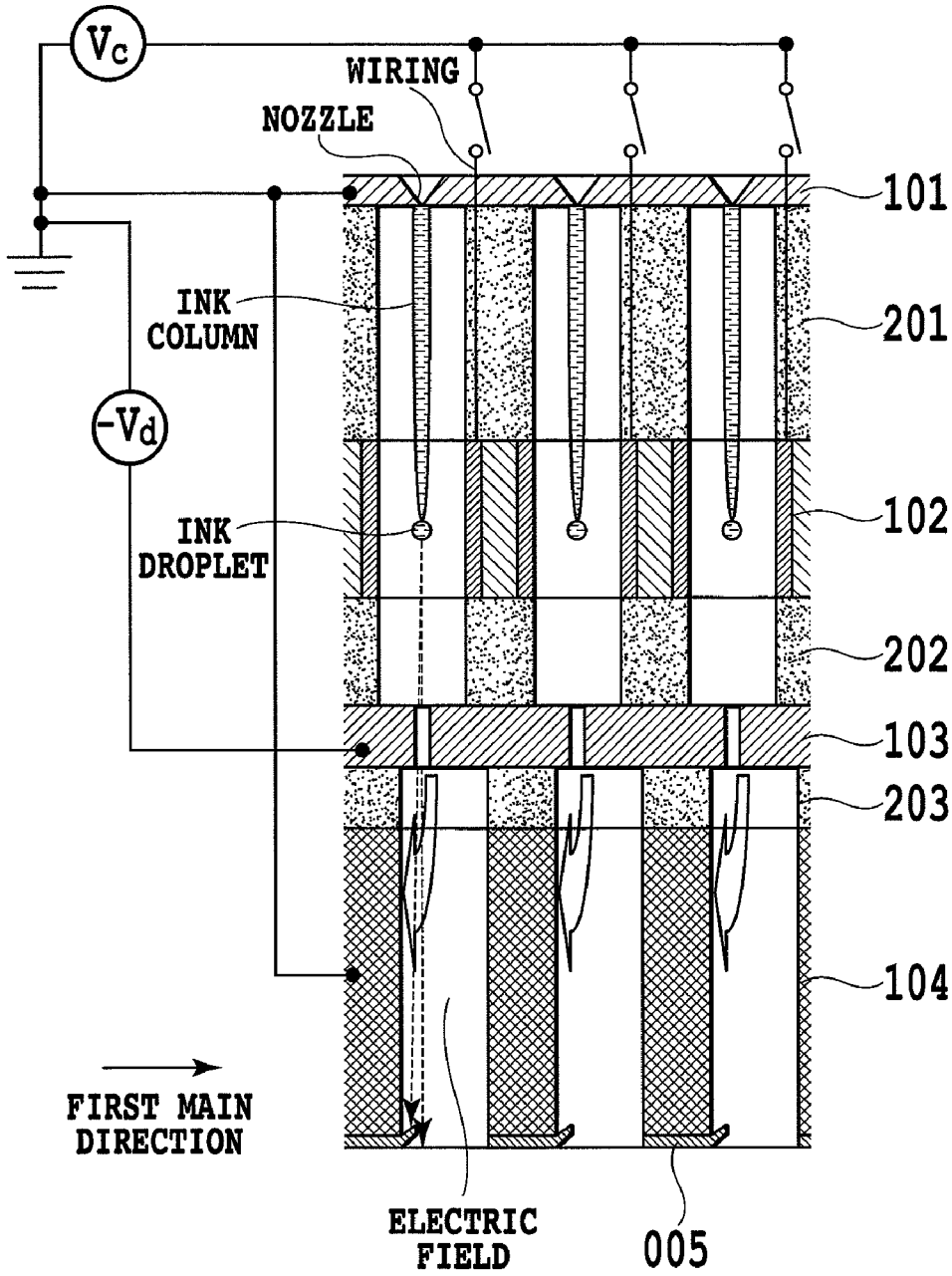
FIG. 3 is a cross-sectional view of the inkjet head illustrated in FIGS. 2A and 2B.
Figure 4:
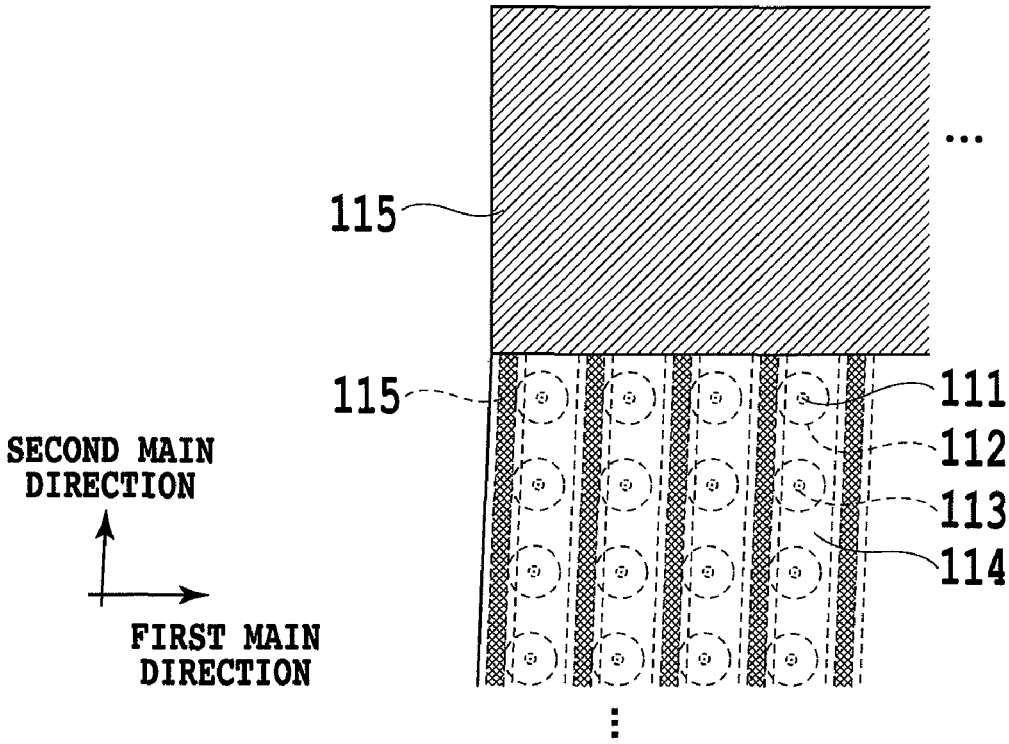
FIG. 4 is a top view of the inkjet head illustrated in FIG. 3.

FIG. 1 is a system schematic diagram illustrating an inkjet device provided with an inkjet head of the present invention. The inkjet device of the present invention includes an ink tank 001, a pressure pump 002, a vibration excitation mechanism 003, a head 004, a recovery pump 006, and an ink adjustment section 007. FIGS. 2A and 2B are a perspective view and an exploded perspective view of the head (note that a gutter is not illustrated). FIG. 3 is a cross sectional view of the head. FIG. 4 is a top view of the head.

With reference to FIGS. 1 to 4, the head will be described in detail. The head 004 includes an orifice plate 101 as a nozzle member, a charging electrode plate 102 as a charging member, a first deflection electrode plate 103 as a first deflection member, and a second deflection electrode plate 104 as a second deflection member. The head 004 further includes a gutter 005 and insulating spacers 201, 202, and 203.

The members composing the head 004 have a plate-like shape and are laminated in a flying direction of ink. The insulating spacers as insulating members are interposed between the orifice plate 101 and the charging electrode plate 102, between the charging electrode plate 102 and the first deflection electrode plate 103, and between the first deflection plate 103 and the second deflection electrode plate 104, respectively.

In the orifice plate 101, a plurality of nozzles to eject ink are arranged in a two dimensional manner along a first main direction (a first direction) and a second main direction (a second direction). The charging electrode plate 102 is provided with through-holes that the ejected ink passes through, and an electrode is formed on an inner wall within each of the through-holes. The electrode is connected to wiring so that the electrode can apply a charged voltage so as to individually apply electric charge to ink droplets.

The first deflection electrode plate 103 is provided with through-holes that the ejected ink passes through. The first deflection electrode plate 103 is formed with an electrode, and a position of the electrode is on an inner wall of each of the through-holes and/or a surface facing the second deflection electrode plate 104. Since the electrode of the first deflection electrode plate 103 does not need to individually apply a voltage, unlike the electrode of the charging electrode plate 102, electrodes corresponding to the respective through-holes may be connected to each other by wiring so as to have the same electric potential. Alternatively, the first deflection electrode plate 103 may be made of a conductive member so that an entire member has the same electric potential to omit patterning of the electrodes and wiring within the electrode plate.

The second deflection electrode plate 104 is provided with through-holes that the ejected ink passes through, and an electrode is formed on an inner wall of each of the through-holes. Since the electrode does not need to individually apply a voltage, unlike the electrode of the charging electrode plate, the electrodes are connected to each other by wiring so as to have the same electric potential. The second deflection electrode plate 104 may be made of a conductive member to thereby omit the patterning of the electrodes and wiring. Further, the second deflection electrode plate may be made of a porous member so as to also function as a gutter. The first deflection electrode and second deflection electrode are configured to be laminated in a flying direction of ink, and there is no electrode that has a different electric potential on the same plane vertical to the flying direction. This enables wiring to be simplified and a highly-dense multi-nozzle head to be realized.

Next, operation of the inkjet device according to the present invention will be described. Ink stored in the ink tank 001 is pressurized by the pressure pump 002 and supplied to the head 004. The ink supplied to the head 004 is vibrated by the vibration excitation mechanism 003 and ejected from a nozzle 111. When the ink ejected from the nozzle 111 flies about 1 mm, the ink is divided into ink droplets from a liquid column. The charging electrode plate 102 is placed at the position where an ink column is divided into the ink droplets so that the ink droplets pass through the through-holes. At the time of the division into the ink droplets, if a voltage is applied to the electrode, the ink droplets are charged whereas if a voltage is not applied the electrode, the ink droplets are not charged. Therefore, a voltage to be applied to the charging electrode is controlled depending on print data so that ink droplets to be used for printing are uncharged whereas ink droplets not to be used for printing are charged. After that, the uncharged ink droplets fly linearly to drop on a print medium. A voltage is applied between the first deflection electrode plate (first deflection member) 103 and the second deflection electrode plate (second deflection member) 104, and the charged ink droplets are deflected by an electric field when the charged ink droplets pass through the two deflection electrodes. The deflected ink droplets are recovered by the gutter 005. The recovered ink is absorbed by the recovery pump 006, subjected to the dirt removal and viscosity adjustment by the ink adjustment section 007, and again pressurized by the pressure pump 002 and circulated to the head 004 for printing.

Conductive ink is used in order to be charged. Therefore, the gutter 005 and orifice plate 101 are brought into an electrically conductive state by the circulating ink. The second deflection electrode plate 104 is often electrically conducted to the recovered ink droplets, and therefore, a voltage is preferably applied to supplied ink, the charging electrode and the deflection electrodes in such a way that a voltage to be applied to the supplied ink and second deflection electrode plate 104 is set to 0V (GND) and a voltage is applied to the charging electrode and first deflection electrode.

Next, a first embodiment of the present invention will be described.

First, a method for producing an inkjet head of the present invention will be described. First, a method for producing the orifice plate 101 will be described with reference to FIGS. 5A to 5D. As a substrate 301, an SOI (silicon on insulator) wafer is used. A thickness of a handle layer is 300 μm and the crystal face orientation is (100). A thickness of a BOX layer 302 is 0.2 μm and a thickness of a device layer is 3 μm.

Figure 5A:
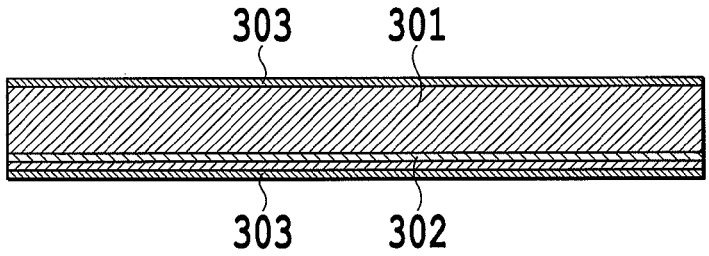
FIGS. 5A to 5D are process diagrams of an orifice plate according to a first embodiment.

In a first process illustrated in FIG. 5A, a silicon nitride layer 303, which will become a mask, is formed on both surfaces of the substrate. FIG. 5A illustrates a state in which the device layer of the SOI wafer is placed downward. The silicon nitride layer 303 can be formed using a process such as a CVD process. Instead of the silicon nitride layer, a silicon oxide film may be formed by thermal oxidation.

Figure 5B:
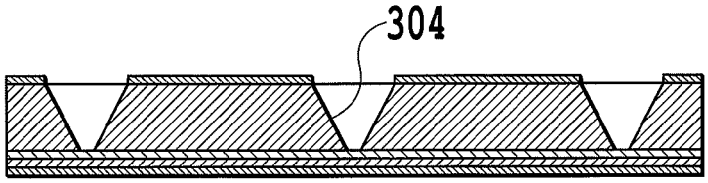

In a second process illustrated in FIG. 5B, an individual flow channel 304 corresponding to each nozzle is formed. The silicon nitride layer on the handle layer side of the substrate 301 is patterned by photolithography, and the handle layer is etched with the use of the silicon nitride layer as a mask. The handle layer is etched by anisotropic wet etching. As an etchant, KOH (potassium hydrate) can be used. In this etching, since an etching rate is significantly different depending on a silicon crystal face, tapered etching is possible as illustrated in FIG. 5B. A tapered portion of the etched silicon has a structure in which the face with the crystal face orientation (111) is exposed. In the KOH wet etching, since an etching rate of a silicon oxide is much lower than that of silicon, etching is stopped at the BOX layer of the SOI substrate. If a mask shape is a square, an etched shape will be trapezoidal. In the present embodiment, a nozzle interval is set to 500 μm and a width of the bottom of the flow channel after the etching is set to 20 μm. Note that in the present embodiment, the anisotropic wet etching is used, but the individual flow channel can also be formed by deep dry etching using ICP-RIE. In this case, etching is not tapered, but silicon can be vertically etched. This method has advantages that a plane orientation of the substrate does not need to be specified, and the individual flow channel having a circular-tube shape can be formed by using a circular-shaped mask, and other advantages. Meanwhile, the aforementioned anisotropic wet etching has advantages that a plurality of substrates can be simultaneously etched, and the individual tapered flow channel with a low channel resistance and high strength can be formed.

Figure 5C:
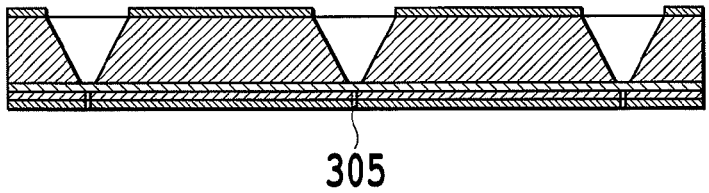

In a third process illustrated in FIG. 5C, a nozzle orifice 305 is formed. The silicon nitride layer on the device layer side (the lower side in FIG. 5C) of the substrate 301 is patterned, and the device layer is etched with the use of the silicon nitride layer as a mask. Each of the masks used in the processes in FIGS. 5B and 5C is provided with alignment marks, and on the basis of the alignment marks, the mask is aligned so that the center of the orifice matches the center of the individual flow channel. For the etching, dry etching by RIE is used. Since the etching rate of silicon oxide is much lower than that of silicon, etching is stopped at the BOX layer of the SOI substrate. In the present embodiment, an orifice diameter is set to 7.4 μm.

Figure 5D:
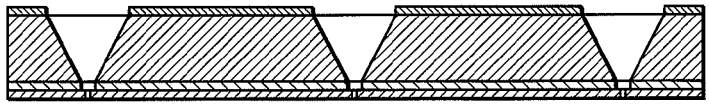

In a fourth process illustrated in FIG. 5D, the silicon nitride layer on the substrate surface and the BOX layer at the bottom of the individual flow channel are removed by etching to thereby pierce a part between the individual flow channel and nozzle orifice. For the etching, wet etching by buffered fluorinated acid (BHF) is used. Note that, after this process, a silicon nitride layer or a silicon oxide layer may be formed on the surface of the flow channel in order to increase corrosion resistance.

In the above manner, the orifice plate according to the present invention can be produced. Other methods for producing the orifice include etching processing, press processing, and laser processing of a metal plate, and electrocasting.

Next, a method for producing the charging electrode plate 102 will be described with reference to FIGS. 6A to 6F. As a substrate, a silicon wafer having a thickness of 500 μm is used.

Figure 6A:
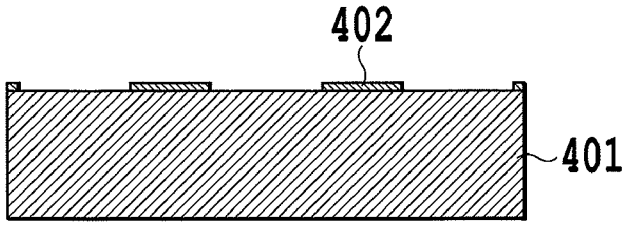
FIGS. 6A to 6F are process diagrams of a charging electrode plate according to the first embodiment.

In a first process illustrated in FIG. 6A, a mask 402 for etching is formed on the substrate 401. A material such as Cr can be used for the mask. A film of Cr is deposited on a surface of the substrate, and then patterned by photolithography.

Figure 6B:
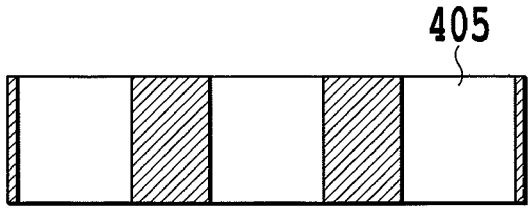

In a second process illustrated in FIG. 6B, through-holes 405 that ink passes through are formed with the use of the mask 402 produced in the first process. By using etching by ICP-RIE to etch the through-holes, deep etching with a high aspect ratio can be performed. In the present embodiment, each of the through-holes is configured to have a circular cross-section and a hole diameter of 300 μm. After the etching, Cr used for the mask is removed by etching.

Figure 6C:
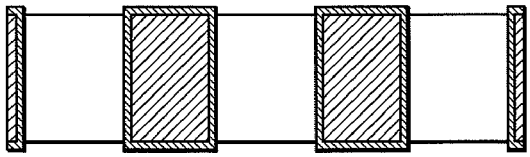

In a third process illustrated in FIG. 6C, a conductive layer is formed by plating on the substrate surface and an inner wall of each of the through-holes. Electroless plating of Au is used.

Figure 6D:
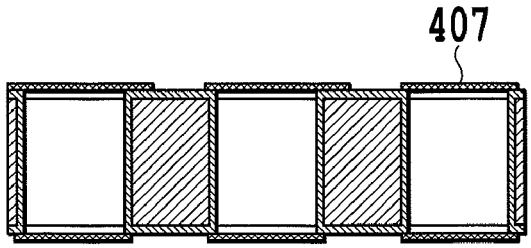

In a fourth process illustrated in FIG. 6D, a film-like resist 407 is formed on the substrate surface. A laminator is used to form the resist to also coat the surface of each of the through-holes 405. Further, by patterning the film resist, a pattern of an electrode is formed on the substrate surface (the same applies to the back surface of the substrate 401).

Figure 6E:
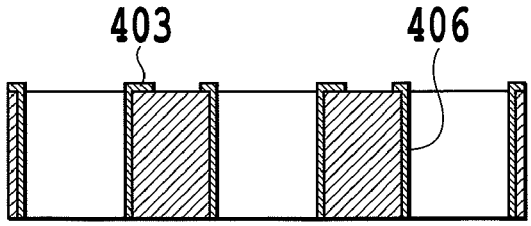

In a fifth process illustrated in FIG. 6E, on the basis of the resist pattern produced in the fourth process, the conductive layer of the substrate surface is etched. By removing the resist, a wiring layer 403 is formed.

Figure 6F:
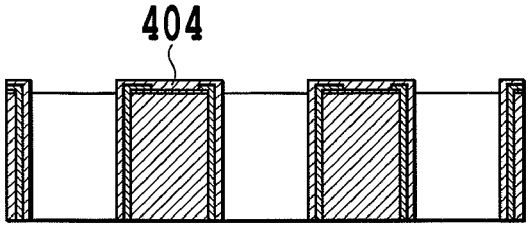

In a sixth process illustrated in FIG. 6F, a surface of the wiring 403 is coated with a protective coating film 404. As a material for the coating, a material with high insulation property and high corrosion resistance, such as parylene or polyimide, is used. A film of parylene can be deposited by CVD, and a film of polyimide can be formed by spin coating. These materials have a feature that a coverage is high even if the surface to be covered is uneven.

In the above manner, the charging electrode plate according to the present invention can be produced. The case where the silicon wafer is used as the substrate has been described, but photosensitive glass may be used as the substrate. In this case, the through-holes are formed by wet etching. The substrate of photosensitive glass has higher insulating property than the substrate of silicon. On the other hand, the silicon substrate has higher processing accuracy of the through-holes than the photosensitive glass substrate. Also, to form the electrode 406, the plating has been used, but oblique evaporation may be used to deposit a conductive material on the inner wall of each of the through-holes 405.

Other methods for producing the charging electrode plate include a method that fires a ceramic material, patterns wiring on the surface, and forms the electrode by plating, and a method that forms through-holes in a printed board material by laser, and forms the wiring and electrode in the same way.

Figure 7A:
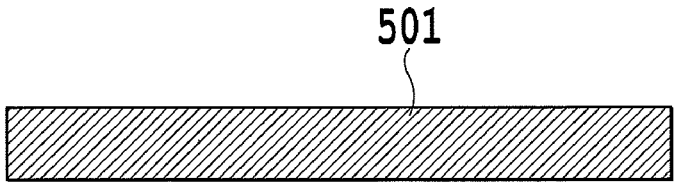
FIGS. 7A and 7B are process diagrams of a first deflection electrode plate according to the first embodiment.
Figure 7B:
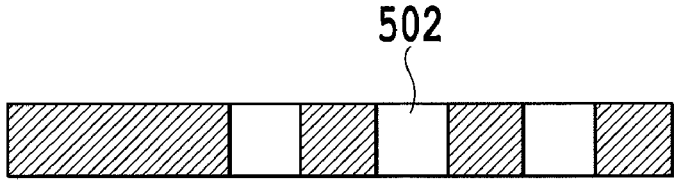

Next, a method for producing the first deflection electrode plate 103 will be described with reference to FIGS. 7A and 7B. For a substrate 501, a conductive member having corrosion resistance, such as stainless steel, is used, as illustrated in FIG. 7A. In the present embodiment, a thickness of the substrate is set to 200 μm. As illustrated in FIG. 7B, through-holes 502 that ink passes through are formed. In the present embodiment, each of the through-holes 502 is configured to have a circular cross section and a hole diameter of 50 μm. To form the through-holes 502, etching, press, or laser processing can be used. Further, gold plating may be applied to a surface of the electrode plate in order to increase conductivity and corrosion resistance.

Next, a method for producing the second deflection electrode plate 104 will be described with reference to FIGS. 8A to 8G. Especially, a method for producing a configuration in which a gutter and an ink recovery path are integrated for further downsizing will be described here, but the gutter and ink recovery path may be separately produced and placed. For a first substrate 601 illustrated in FIG. 8A, a conductive member having corrosion resistance, such as stainless steel, is used. In the present embodiment, the substrate has a thickness set to 800 μm.

Figure 8A:
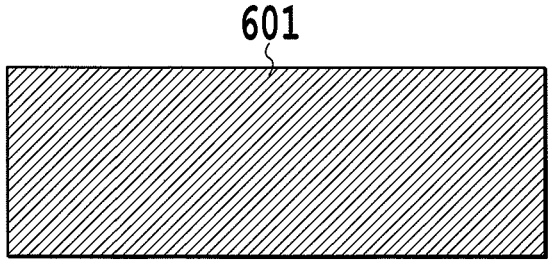
FIGS. 8A to 8G are process diagrams of a second deflection electrode plate according to the first embodiment.
Figure 8B:
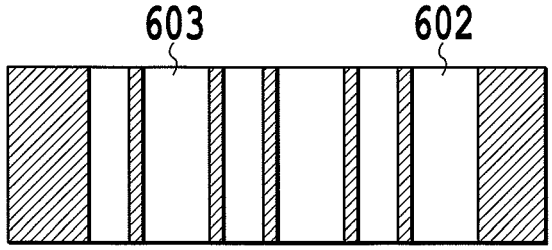
Figure 9A:
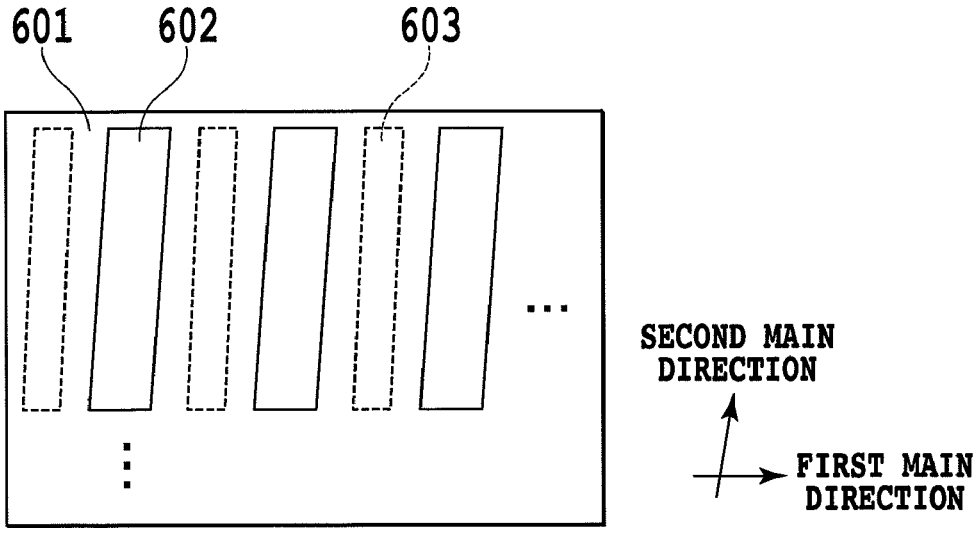
FIGS. 9A and 9B are views of the second deflection electrode plate according to the first embodiment.
Figure 9B:
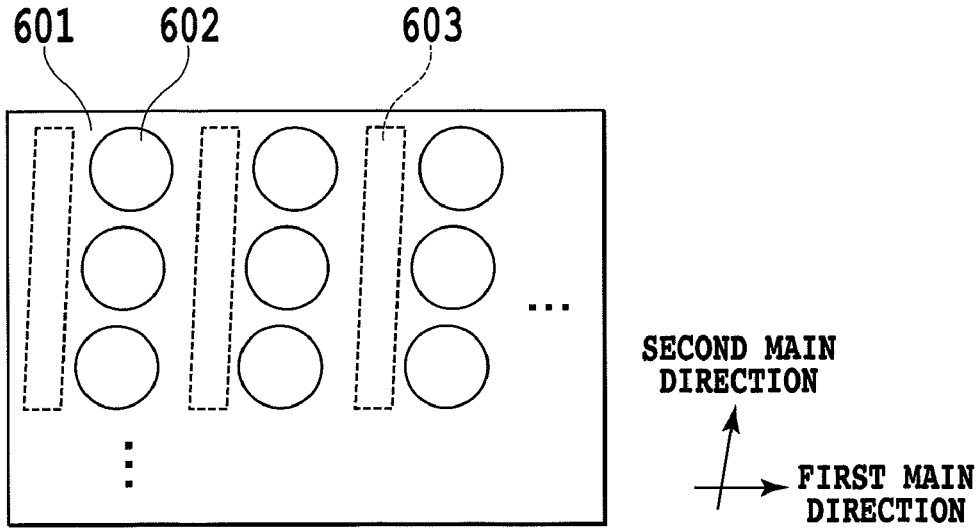

In a first process illustrated in FIG. 8B, an ink flying path 602 that ink passes through and an ink recovery path 603 to recover ink are formed. The ink recovery path 603 is formed in a slit-like shape extending in a depth direction, as illustrated in FIG. 8B. Also, the flying path 602 is formed in a slit-like shape (see FIG. 9A) extending in the depth direction, as illustrated in FIG. 8B. Alternatively, the flying path 602 is composed of individual through-holes (see FIG. 9B), each of which extends from a front surface to back surface of the substrate and corresponds to each of ink droplet lines that pass through. The ink flying path 602 and ink recovery path 603 can be formed by using etching, press, or laser processing.

Figure 8C:
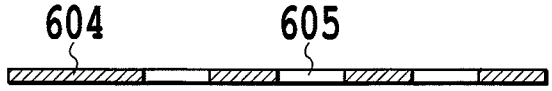

In a second process illustrated in FIG. 8C, an ink flying path 605 that ink passes through is formed in a second substrate 604. The second substrate has a thickness set to 100 μm. The ink flying path 605 can be formed by using etching, press, or laser processing.

Figure 8D:
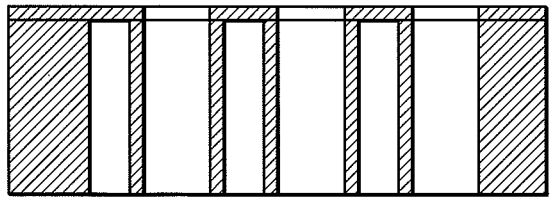
Figure 8E:
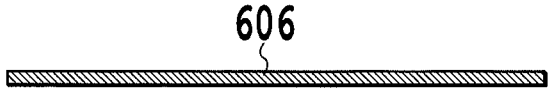

In a third process illustrated in FIG. 8D, the first substrate 601 and second substrate 604 are bonded to each other. The two substrates are aligned and bonded to each other so that the position of the ink flying path 602 matches the position of the ink flying path 605, and thereby a top portion of the recovery path is covered. As the bond, an epoxy-based bond can be used.

Figure 8F:
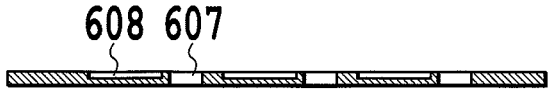

Next, a process to form the gutter will be described. For a substrate illustrated in FIG. 8E, stainless steel or the like is used. The substrate has a thickness set to 100 μm. As illustrated in FIG. 8F, an ink flying path 607 and an ink recovery path 608 are formed. As the processing method, etching (step etching that uses different-shaped masks respectively for both surfaces) or press processing can be used.

Figure 8G:
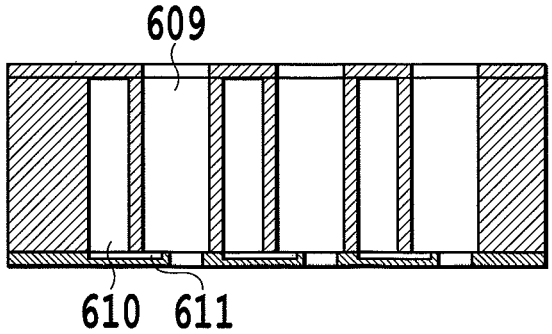

Finally, as illustrated in FIG. 8G, the two substrates are aligned and bonded to each other so that the position of the ink flying path 605 of the member produced in the process in FIG. 8D matches the position of the ink flying path 607 of the member produced in the process in FIG. 8F.

In the above manner, the second deflection electrode plate (second deflection member) that has an ink flying path (through-hole) 609, a gutter 611, and an ink recovery path 610 can be formed. Further, gold plating may be applied to a surface of the electrode plate in order to increase conductivity and corrosion resistance. If the substrate 601 is thick and therefore accurate processing is difficult, several thinner substrates may be provided, processed and bonded to each other.

The orifice plate 101, charging electrode plate 102, first deflection electrode plate 103 and second deflection electrode plate 104 (including the gutter and ink recovery path) produced by the aforementioned methods are laminated as illustrated in FIGS. 2A and 2B to thereby complete the inkjet head. In the laminating, electrically insulating spacers are interposed between the respective members to be thereby able to keep distances between the respective members constant and electrically insulate the respective members from each other.

Thus, since each of the members has the through-holes that ink passes through and these members are laminated in the flying direction of ink, there is an advantage that even if the number of nozzles is increased, the number of components does not increase. Especially, since the first deflection electrode plate 103 and second deflection electrode plate 104 are conductive plate-like members, each of the electrode plates does not need patterning of wiring and has a very easy-to-process structure.

Figure 10B:
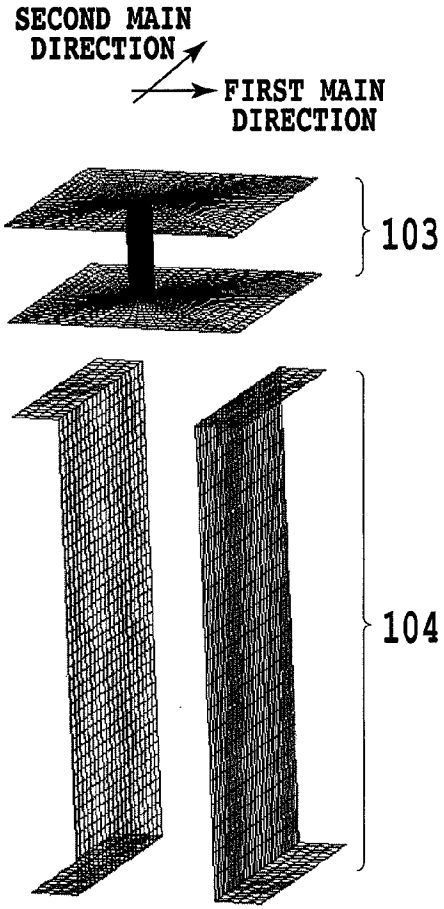
FIG. 10B is a perspective view illustrating a model of the electric field simulation in the deflection electrode plates according to the first embodiment.
Figure 10A:
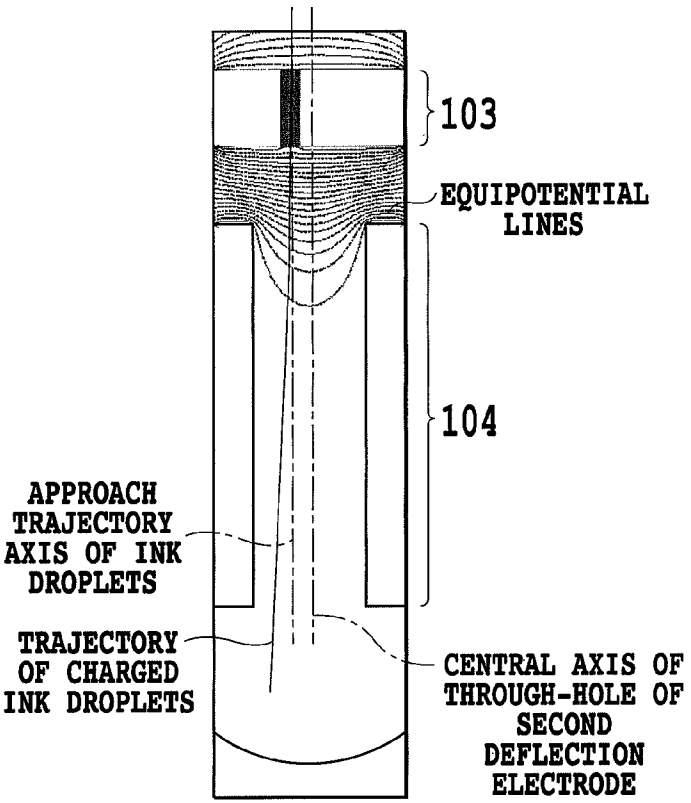
FIG. 10A is a diagram illustrating a result of an electric field simulation in the deflection electrode plates according to the first embodiment.

Next, operational conditions of the inkjet device in the present embodiment will be described. In the inkjet device, a nozzle diameter is 7.4 μm, a pressure of the pressure pump 002 is 0.8 MPa, and a vibration frequency of the vibration excitation mechanism 003 is about 50 kHz. In this case, a size of an ink droplet is 4 pL, and an ejection speed is about 10 m/s. The speed of flying ink droplets is reduced by air resistance, and is about 8 m/s at the time when they pass through the first deflection electrode plate 103. FIG. 10A illustrates a simulation result of equipotential lines of an electric field in the deflection electrodes and a trajectory of the charged ink droplets under the condition that a charge amount at the charging electrode is $-6\times10^{-13}$ [C], an electric potential of the first deflection electrode plate 103 is −100 [V], and an electric potential of the second deflection electrode plate 104 is 0 [V]. For the simulation, a three-dimensional nonlinear static electric field analysis software ELFIN (Elf Corporation) was used. FIG. 10B illustrates a perspective view of a structure model used for the simulation. The equipotential lines are formed between the lower surface of the first deflection electrode plate 103 and the upper surface and through-hole inner walls of the second deflection electrode plate 104, and a shape of the equipotential lines is approximately mirror-symmetrical to a central axis line of the through-hole of the second deflection electrode plate 104. (To be more accurate, a symmetrical axis line is a central line between electrode surfaces of the inner walls of the second deflection electrode plate 104. Strictly speaking, the equipotential lines are not mirror-symmetrical due to the through-hole of the first deflection electrode plate 103.) Electric flux lines are vertical to the illustrated equipotential lines, and therefore, if negatively-charged ink droplets approach from right toward this central axis line, they are deflected rightward, whereas if they approach from left toward this central axis line, they are deflected leftward (if a polar character of the charging electrode or a polar character of the deflection electrodes is reversed, a deflection is reversed). In the present embodiment, an approach trajectory axis line of the ink droplets toward the through-hole shifts leftward by 50 μm in a first main direction from the central axis line of the through-hole of the second deflection electrode plate 104. Therefore, the charged ink droplets are subjected to electrostatic force so as to be deflected leftward and their trajectory becomes one illustrated in FIG. 10A. The charged ink droplets are deflected by 42 μm at the lower end of the second deflection electrode. These are then recovered by the gutter (in this simulation, the gutter 005 in FIG. 3 is not illustrated). On the other hand, uncharged ink droplets are not deflected, fly linearly, and land on a print medium below.

Second Embodiment

Next, a second embodiment of the present invention will be described. In the present embodiment, other methods for producing the first deflection electrode plate 103 and second deflection electrode plate 104 in the first embodiment will be described. In the first embodiment, the methods for producing these members by using the conductive substrates are described, but in the present embodiment, these members are respectively produced by depositing conductive films on surfaces of insulating substrates.

Figure 11A:
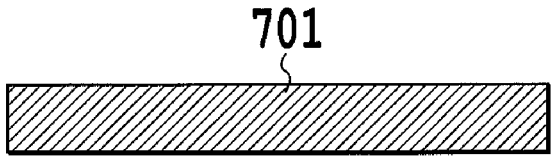
FIGS. 11A to 11C are process diagrams of a first deflection electrode plate according to a second embodiment.
Figure 11B:
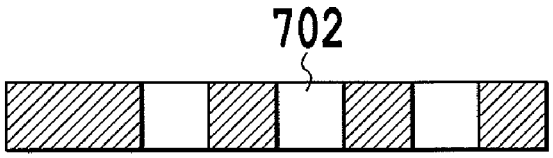
Figure 11C:
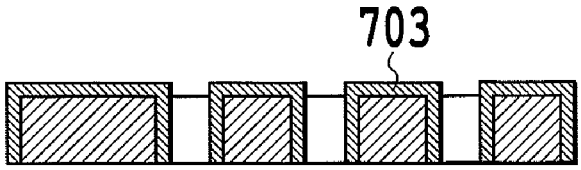

First, a method for producing the first deflection electrode plate 103 will be described with reference to FIGS. 11A to 11C. A substrate illustrated in FIG. 11A is a silicon wafer. In the present embodiment, the silicon wafer with a thickness of 200 μm is used. First, through-holes (ink flying path) 702 are formed in the substrate 701 by ICP-RIE (see FIG. 11B). For the etching, a mask is used, which is formed in such a way that a thermal oxide film or aluminum is preliminarily formed and patterned by photolithography. Next, a film of metal, which will become an electrode, is deposited (see FIG. 11C). For the electrode 703, a metal thin film with corrosion resistance, such as Au, is suitable. Also, it is better to deposit a thin film of Ti or the like as a base layer in order to increase adhesion to the substrate. In FIG. 11C, a metal layer is also formed on the electrode side surface, but as long as the top surface has the metal layer, it can function as the electrode. However, in order to prevent charging when ink mist is attached, it is preferable that a side wall of the through-hole 702 has the metal layer. For example, if vacuum evaporation is used to deposit the metal film layer, the film layer is unlikely to be deposited on an inner wall, whereas if sputtering is used, the film layer is likely to be deposited also on the inner wall.

When the first deflection electrode plate 103 produced in this manner is assembled, a surface that the electrode is formed on is placed so as to face the second deflection electrode plate 104, which enables the electrode surface to be more away from the charging electrode plate as compared with the first embodiment. This has an advantage to reduce an effect of an electric field of the first deflection electrode plate 103 on a charging process of ink droplets. Further, by forming an insulating film layer on the electrode surface, it can be used also as the insulating spacer. Alternatively, the first deflection electrode plate 103 may be placed so that the surface on which an electrode is formed faces the charging electrode plate 102, to thereby make the substrate 701 function as the insulating spacer. These make the third insulating spacer 203 unnecessary, resulting in advantages of reducing the number of components and a distance between a nozzle and a medium to be printed.

Figure 12A:
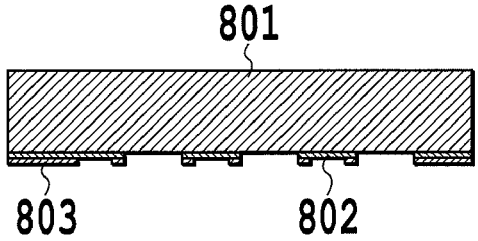
FIGS. 12A to 12G are process diagrams of a second deflection electrode plate according to the second embodiment.

Next, a method for producing the second deflection electrode plate 104 will be described with reference to FIGS. 12A to 12G. In a first process illustrated in FIG. 12A, a mask to produce a top portion of the second deflection electrode plate 104 is patterned. In the present embodiment, as a first substrate 801, a double-side polished silicon substrate with a thickness of 400 μm is used. First, a mask for etching an ink recovery path 804 and an ink flying path 805 is patterned. Since the ink flying path 805 passes through the substrate whereas the ink recovery path does not pass through the substrate, two types of masks are necessary. Therefore, a two-level mask 802, 803 is formed as illustrated in FIG. 12A. As a mask material, a film of aluminum can be formed, and a silicon oxide film can be formed by thermal oxidation. These are patterned by photolithography. The two-level mask may be produced in such a way that the same type material is etched twice to thereby produce the two-level mask with partially different thicknesses, or patterns of different materials are laminated to thereby produce the two-level mask.

Figure 12B:
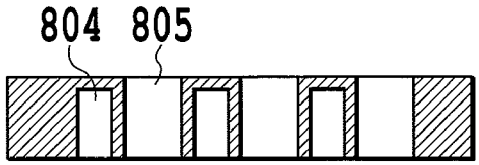

In a second process illustrated in FIG. 12B, the ink flying path 805 and ink recovery path 804 are formed. With the use of the two-level mask produced in the first process, etching is performed by ICP-RIE. After a portion to become the ink flying path is etched by a thickness (100 μm) of the top wall of the ink recovery path, then the second mask 803 is removed, and etching is further performed with only the first mask 802. After that, the first mask 802 is removed.

Figure 12C:
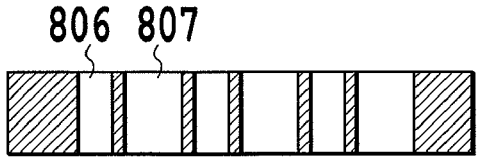

In a third process illustrated in FIG. 12C, a lower portion of the second deflection electrode plate 104 is formed. A double-side polished silicon substrate with a thickness of 500 μm is used as a substrate. A mask is patterned by photolithography, and an ink recovery path 806 and an ink flying path 807 are etched by ICP-RIE. After that, the mask is removed.

Figure 12D:
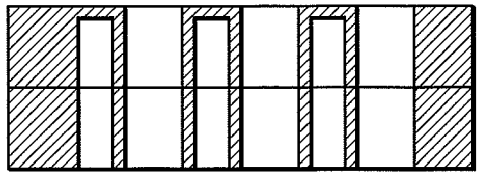

In a fourth process illustrated in FIG. 12D, the upper portion produced in the second process and the lower portion produced in the third process are connected. Alignment marks for aligning are preliminarily formed in the masks for processing the respective members. To connect the members, direct bonding between silicon surfaces may be used or a bond may be used. In the direct bonding, if the bonding is successfully performed, very high bonding strength can be obtained due to covalent bonding of molecules; however, if dirt adheres to the bonding surfaces, bonding yield is significantly reduced. If the bond is used, an epoxy-based bond can be applied with a dispenser to be thereby able to connect the members.

Figure 12E:
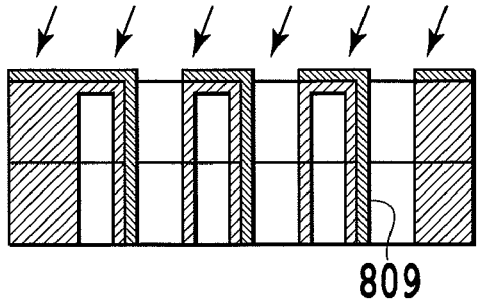
Figure 12F:
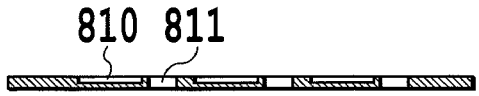

In a fifth process illustrated in FIG. 12E, an electrode 809 and wiring 808 that connects the electrodes are formed. A metal thin film is deposited on a top surface and an inner wall of the ink flying path by using oblique evaporation. As the metal thin film, a metal thin film with corrosion resistance, such as Au, is suitable. Also, in order to increase adhesion to the substrate, it is better to deposit a thin film of Ti or the like as a base layer. The electrodes need to be all electrically connected so that the same voltage can be applied; however, since a voltage does not need to be individually controlled, fine patterning for wiring is not necessary, and for example, the metal film may be formed on the entire top surface.

Next, a gutter portion is formed. In the present embodiment, a double-side polished silicon wafer with a thickness of 100 μm is used as a substrate. A method for forming the gutter portion will be described with reference to FIG. 12F. As with the first process, a two-level mask is formed, and a recovery path 810 and an ink flying path are formed by etching. The etching is performed using ICP-RIE. After the etching, the mask is removed. Further, by forming an insulating film layer on a surface of an electrode, it can be used also as an insulating spacer. In this case, a third insulating spacer can be omitted.

Figure 12G:
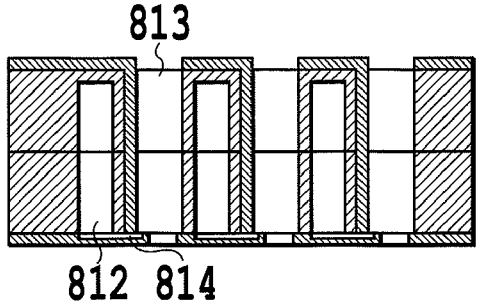

A gutter plate 814 produced in the above manner is connected to the second deflection electrode plate 104 produced in the fifth process (see FIG. 12G). Alignment marks for aligning are preliminarily produced in the masks for the respective members. To connect the members, direct bonding between silicon surfaces may be used, or a bond may be used. In the direct bonding, if the bonding is successfully performed, very high bonding strength can be obtained due to covalent bonding between molecules, however, if dirt adheres to the bonding surfaces, bonding yield is significantly reduced. If the bond is used, an epoxy-based bond can be applied with a dispenser to thereby connect the members.

Figure 13A:
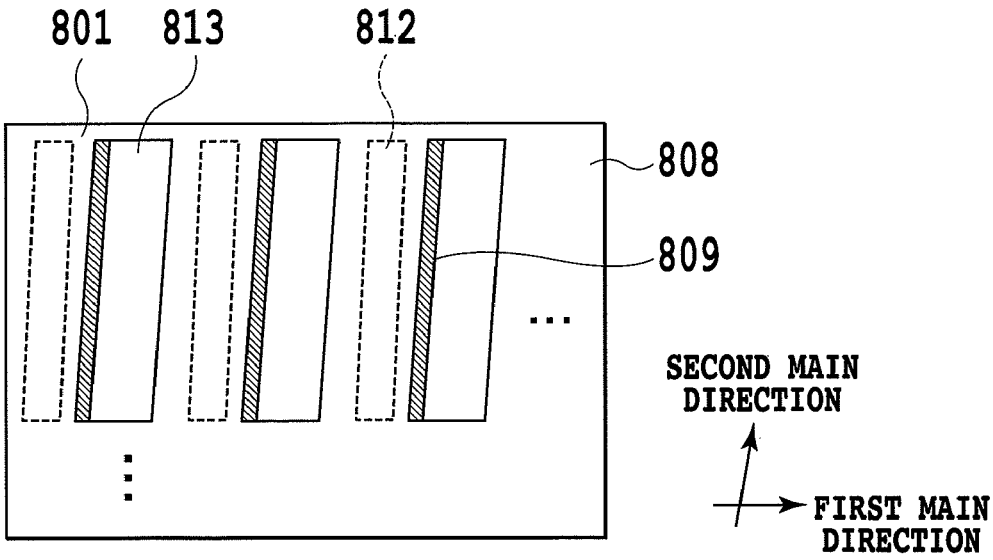
FIGS. 13A and 13B are top views of the second deflection electrode plate according to the second embodiment.
Figure 13B:
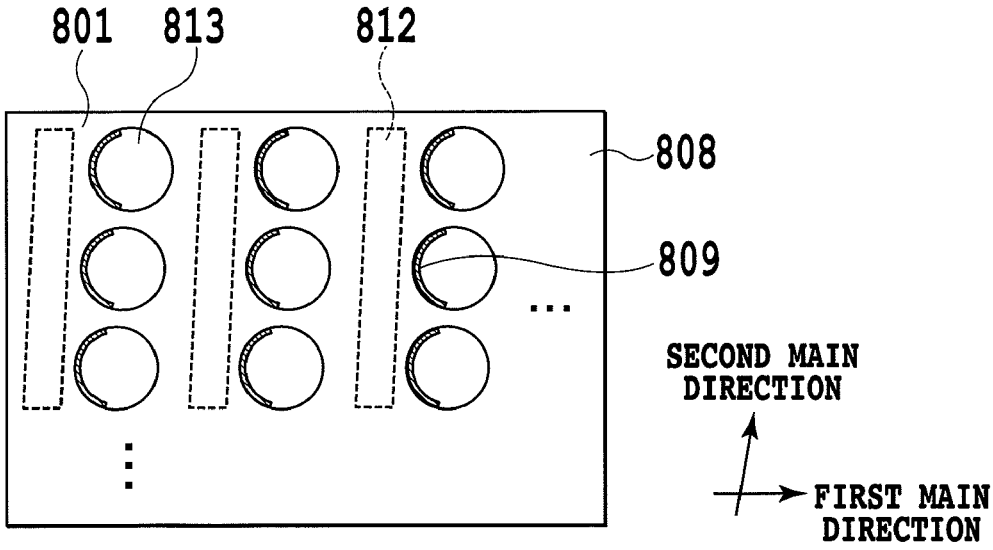

As with the first embodiment, an ink recovery path 812 is configured to have a slit-like shape extending in a depth direction (second main direction). An ink flying path 813 is configured to have a slit-like shape extending in the depth direction (second main direction) (see FIG. 13A), or an individual through-hole corresponding to each ink droplet line that passes through (see FIG. 13B).

In the description of the production process for the second deflection electrode plate 104 of the present embodiment, a method that bonds the electrode members separately etched in the second and third processes together in a fourth process is employed. This is to prevent degradation in processing accuracy due to a taper caused by a high aspect ratio of etching and also to prevent the decrease in etching rate during the process. Depending on conditions of the diameter and depth of a through-hole of an electrode and specifications of etchers to be used, the second deflection electrode plate 104 can be made of one sheet of member, or may be produced in such a way that a plurality of members are etched, laminated and bonded together.

The slit-like through-hole can also be formed by crystal anisotropic wet etching with the use of KOH as an etchant, instead of ICP-RIE. In doing so, a silicon nitride layer is used for the mask, and a substrate having a (110) surface is used.

In the methods for producing the first deflection electrode plate 103 and the second deflection electrode plate 104 according to the present embodiment, since a silicon wafer can be used as a substrate material, etching with a high aspect ratio can be accurately realized. Regarding another materials, a plastic material, ceramic material, and the like can also be used for the substrate. If the plastic material is used, processing is performed by, for example, injection molding, resulting in an advantage of realizing an inexpensive and light-weight electrode plate. If the ceramic material is used, the substrate is produced by, for example, sintering, resulting in an advantage of high corrosion resistance against ink and less thermal expansion.

Since a conductive layer has to be formed, the production methods are more complicated than those of the first embodiment, but the electrodes may have the same electric potential within each of the electrode plate. Therefore, fine patterning of wiring and electrodes is not necessary, which is much simpler as compared with a case in which positive and negative deflection electrodes are formed within the same layer. Methods for producing the other members, a method for assembling an inkjet head, and a configuration and operation method of an inkjet device are identical to those in the first embodiment.

Third Embodiment

A third embodiment according to the present invention will be described. In the present embodiment, another configuration of the second deflection electrode plate 104 will be described. In the first embodiment, the gutter and the ink recovery path are formed in the second deflection electrode by etching whereas the present embodiment is configured such that a porous conductive material 901 that can recover ink is used to thereby make the deflection electrode function also as the gutter and the ink recovery path. That is, deflected charged ink droplets hit against an inner wall of the deflection electrode, and are vacuumed and recovered through the porous portion.

Figure 14A:
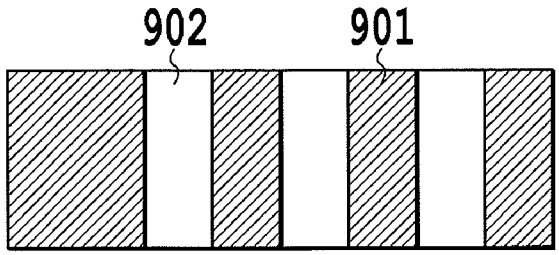
FIGS. 14A to 14C are process diagrams of a second deflection electrode plate according to a third embodiment.

FIG. 14A illustrates a cross-sectional view of the second deflection electrode according to the present embodiment. A porous conductive member is used as a material for the second deflection electrode. Especially, a material with corrosion resistance against ink is preferable. For example, stainless steel foam or porous carbon can be used. These porous materials can be processed by press or laser processing. In the case of a metal material, a desired porous shape can be obtained by placing a powder material into a mold to sinter the material on the basis of a processing method called MIM (metal injection modeling). Such material and processing method are used to form an ink flying path 902.

Figure 14B:
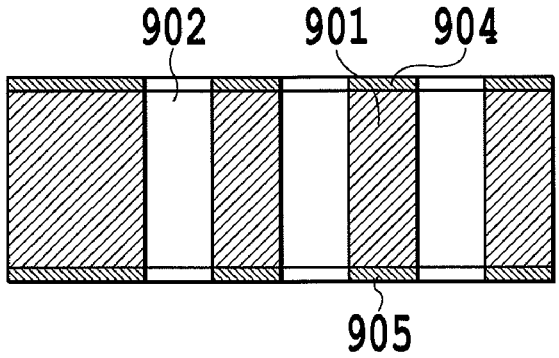
Figure 14C:
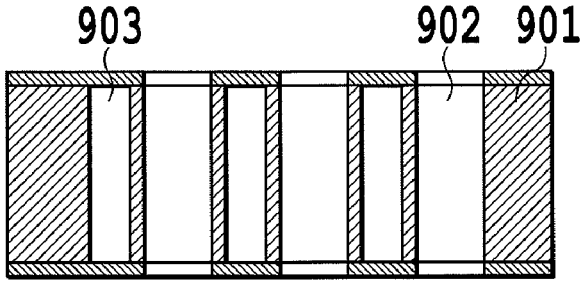

As illustrated in FIG. 14B, a top surface and a bottom surface of the second deflection electrode plate 104 may be sealed. A seal method includes a method to stick thin plates together, each thin plate having a through-hole for an ink flying path, and a method to coat and impregnate the top and bottom surfaces with an adhesive sealing agent with a high viscosity and a high surface tension. Further, as illustrated in FIG. 14C, a hollow flow channel (903) can be formed inside a porous portion, thereby reducing a recovery path resistance.

A method for producing the other members, a method for assembling an inkjet head, and a configuration and operation method of an inkjet device are identical to the first embodiment. As described above, by employing the second deflection electrode plate 104 made of the porous conductive material, processing of a gutter portion can be omitted and the number of components can also be reduced.

Fourth Embodiment

Figure 15:
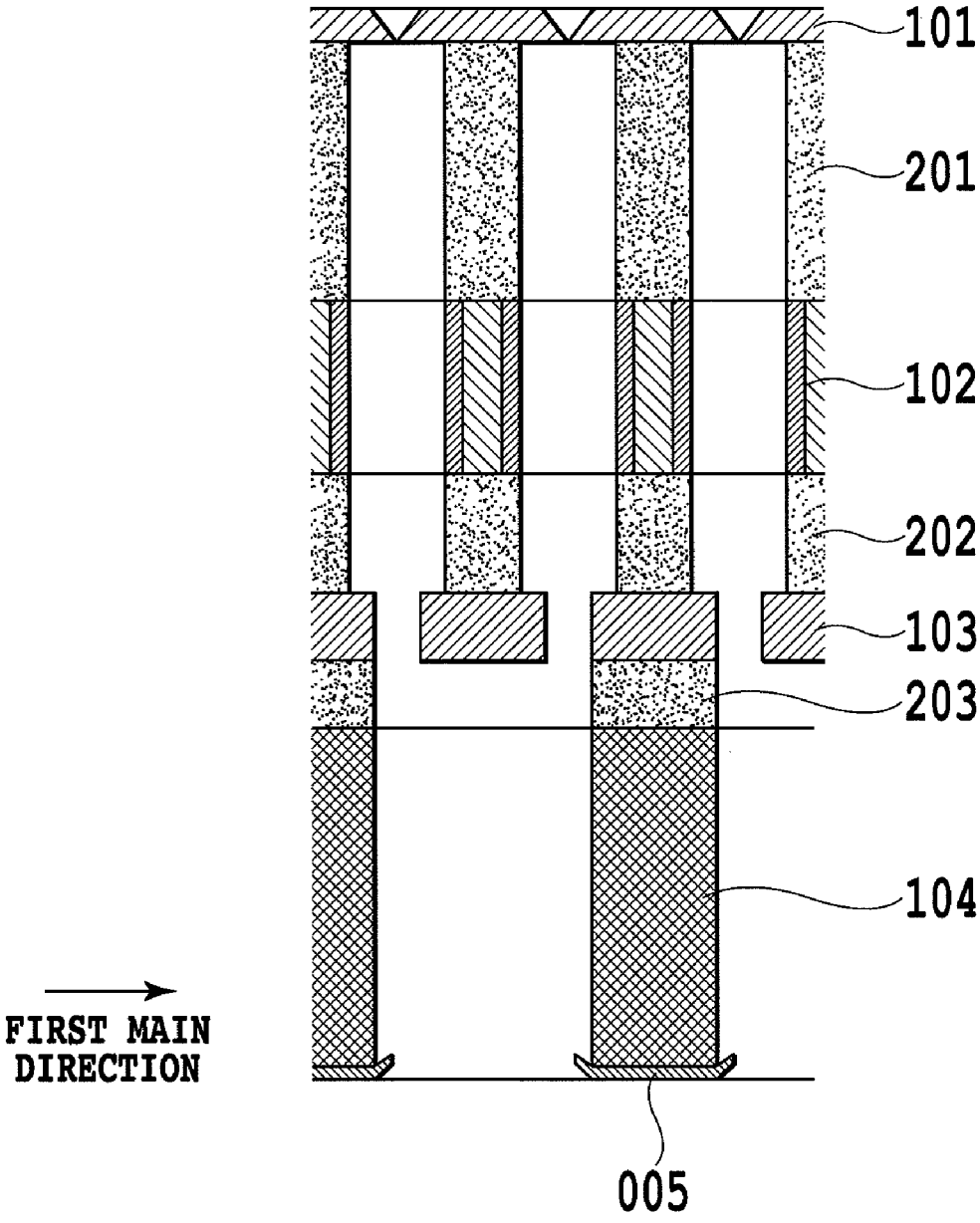
FIG. 15 is a cross sectional view of an inkjet head according to a fourth embodiment.

A fourth embodiment according to the present invention will be described. In the present embodiment, as illustrated in FIG. 15, conductive surfaces of inner walls of through-holes of the second deflection electrode are configured to face each other in a first main direction so as to be sandwiched between trajectories of ink droplets from two adjacent nozzles. Also, a conductive surface of an inner wall of a through-hole is configured to isolate a trajectory of ink droplets from an adjacent nozzle on the other side. Specifically, as compared with the configuration of the first embodiment (see FIG. 3), in FIG. 3, the conductive surface of the through-hole inner wall of the second deflection electrode always exists between adjacent ink droplet trajectories whereas in FIG. 15, the conductive surface exits every other nozzle. In FIG. 15, the inner wall also exits every other nozzle, but the inner wall may exit as long as the conductive surface is not formed (see a third production method that will be described later). Configurations of the other members are identical to those in the first embodiment.

Figure 16A:
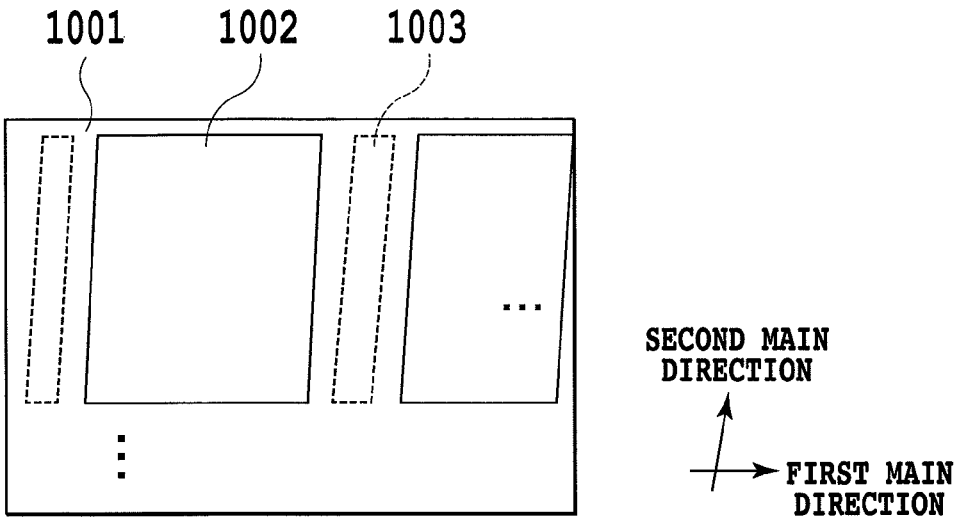
FIGS. 16A and 16B are top views of a second deflection electrode plate produced by a first production method according to the fourth embodiment.
Figure 16B:
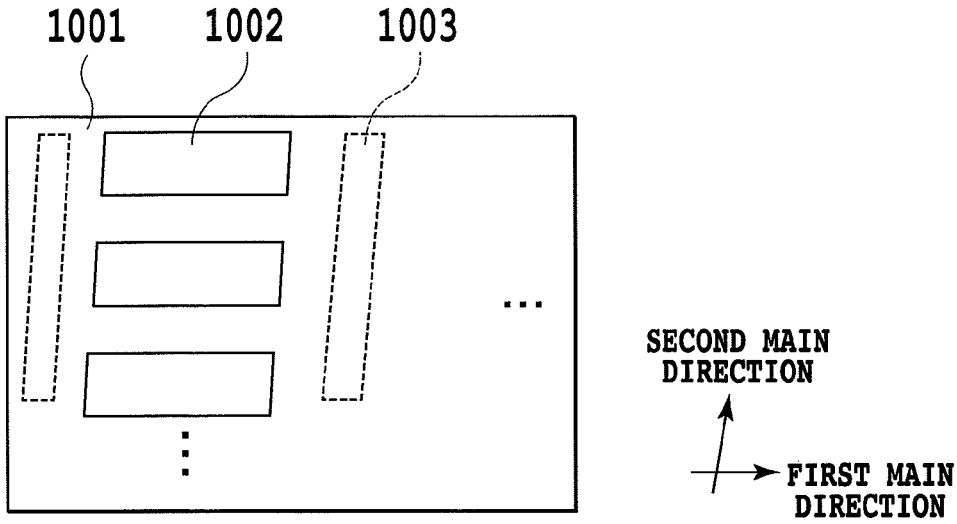
Figure 17A:
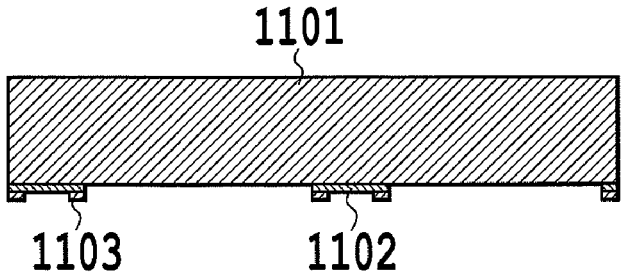
FIGS. 17A to 17E are process diagrams of a second deflection electrode plate by a second production method according to the fourth embodiment.
Figure 17B:
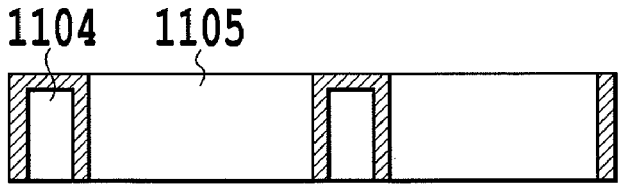
Figure 17C:
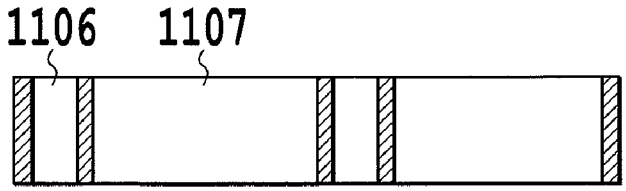
Figure 17D:
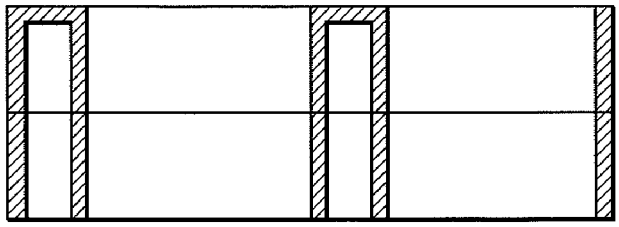
Figure 17E:
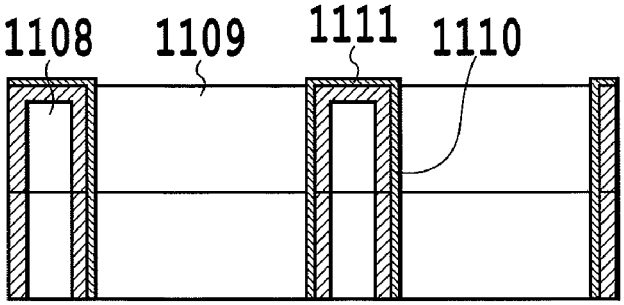

A first method for producing the second deflection electrode plate 104 according to the present embodiment is a method that uses a conductive substrate as a material, and almost identical to the method for producing the second deflection electrode according to the first embodiment. However, sizes of the ink flying path and ink recovery path are different from sizes of the ink flying path 602 and ink recovery path 603 illustrated in FIGS. 8B and 8F. That is, the ink flying path becomes wider and the ink recovery path is provided every other nozzle. FIGS. 16A and 16B illustrate top views of the second deflection electrode plate 104 produced by the first production method according to the present embodiment. As with the first embodiment, the ink recovery path 1003 has a slit-like shape extending in a second main direction. On the other hand, the flying path 1002 has a slit-like shape to cover two nozzle arrays (see FIG. 16A), or through-holes to cover two nozzles (see FIG. 16B).

Figure 19A:
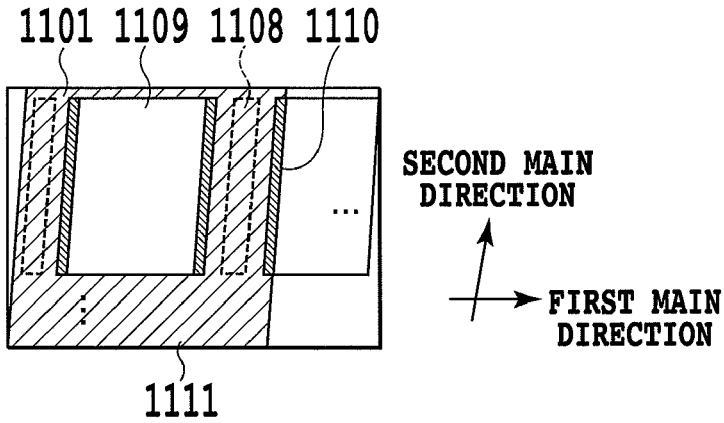
FIGS. 19A and 19B are top views of the second deflection electrode plate produced by the second production method according to the fourth embodiment.
Figure 19B:
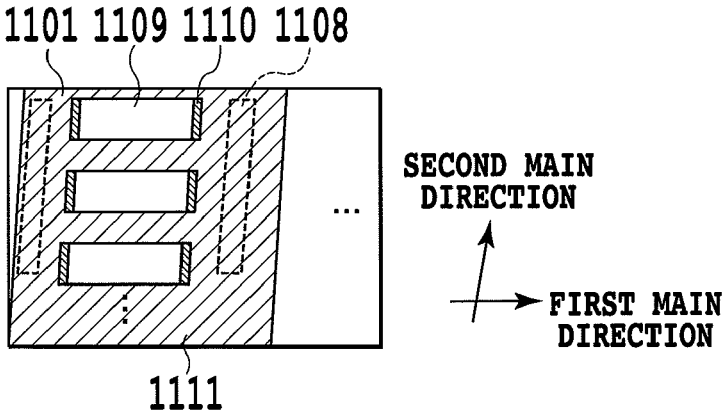

Next, FIGS. 17A to 17E illustrate a second production method for producing the second deflection electrode plate 104 according to the present embodiment. FIGS. 19A and 19B illustrate a top view of the second deflection electrode plate 104 produced by the second production method. As with the second deflection electrode plate 104 produced by the first production method, an ink recovery path 1108 has a slit-like shape extending in a second main direction. On the other hand, an ink flying path 1109 has a slit-like shape to cover two nozzle arrays (see FIG. 19A), or through-holes to cover two nozzles (FIG. 19B).

The second production method uses an insulating substrate as a material, and is almost identical to the method for produce the second deflection electrode according to the second embodiment. However, sizes of the ink flying path and ink recovery path are changed according to a configuration of the present embodiment. For forming an electrode 1110, a film deposition method with high isotropy, such as sputtering, is suitable since a conductive material film is deposited on an inner wall of a substrate. Alternatively, oblique evaporation may be performed twice with changing an angle.

Figure 21:
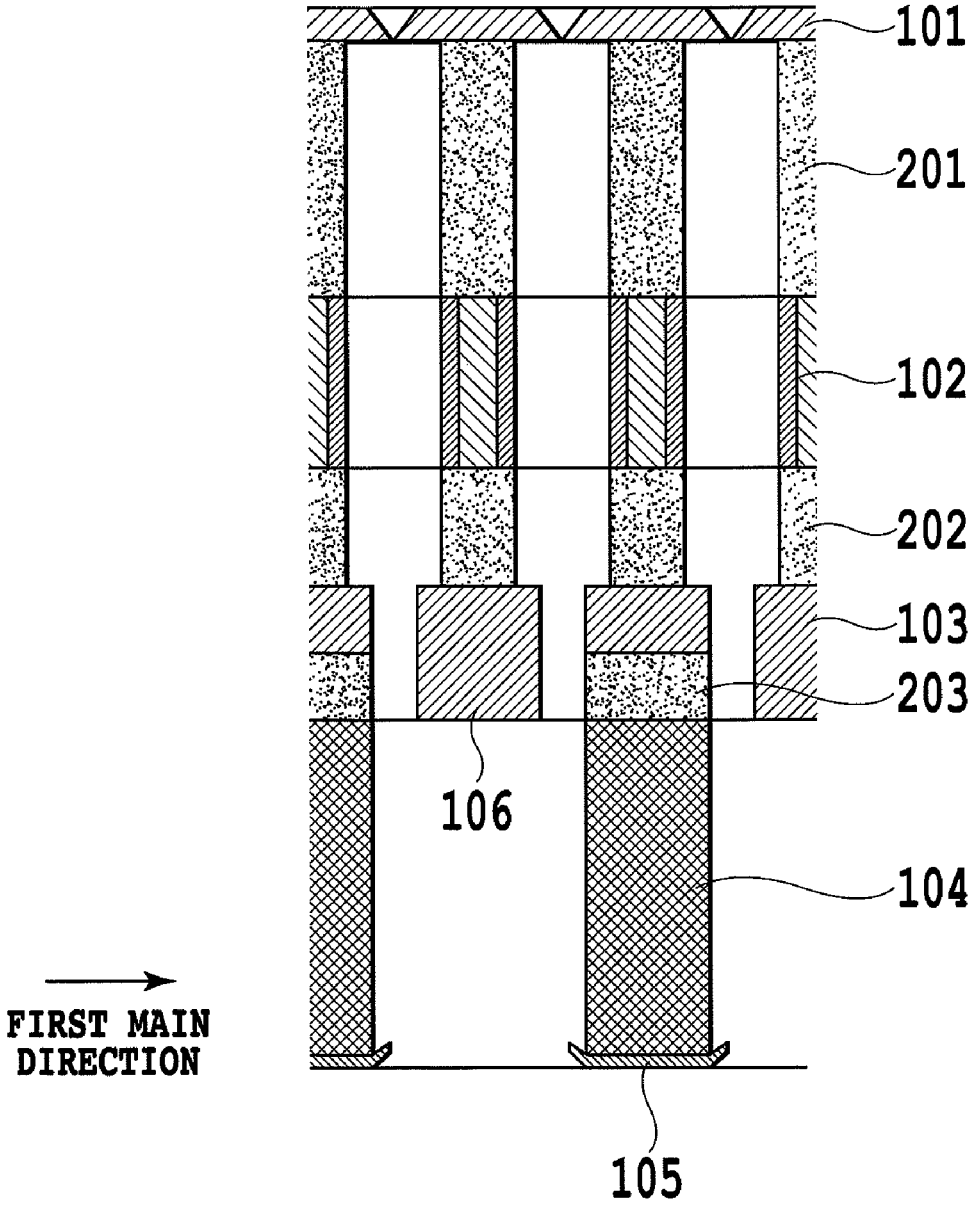
FIG. 21 is a cross sectional view of an inkjet head according to a fifth embodiment.

Next, FIGS. 18A to 18F illustrate a third method for producing the second deflection electrode plate 104 according to the present embodiment. FIG. 21 illustrates a top view of the second deflection electrode plate 104 produced by the third production method. The third production method uses an insulating substrate as a material, and is almost identical to the second production method according to the present embodiment. An ink recovery path 1209 of the second deflection electrode plate 104 produced by this production method has a slit-like shape extending in the second main direction. On the other hand, an ink flying path 1210 has a slit-like shape (see FIG. 19C), or individual through-holes that extend from a front surface to a back surface of the substrate and correspond to respective ink droplet lines that pass thorough (see FIG. 19D). In this case, it is important that an electrode 1211 on an inner wall of the through-hole and wiring 1212 on the top surface are not formed on the entire surface, that is, they are not formed on the side surface and top surface of a portion sandwiched between two ink droplet trajectories.

Figure 18A:
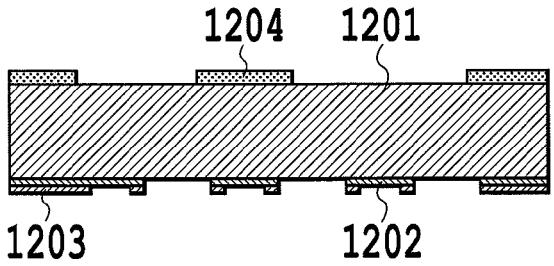
FIGS. 18A to 18F are process diagrams of a second deflection electrode plate by a third production method according to the fourth embodiment.
Figure 18B:
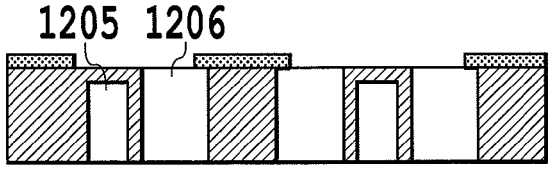
Figure 18C:
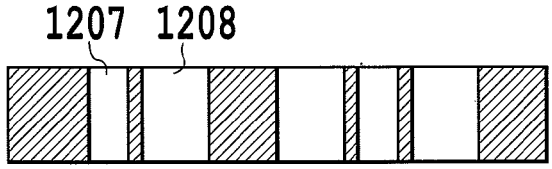
Figure 18D:
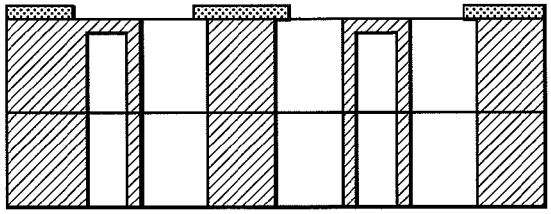
Figure 18E:
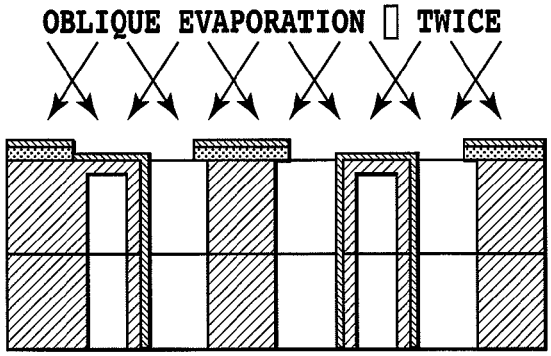
Figure 18F:
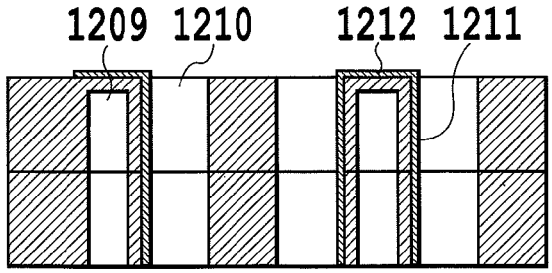
Figure 19C:
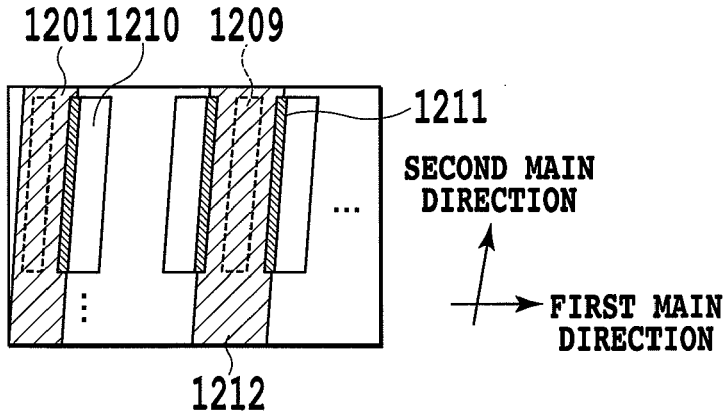
FIGS. 19C and 19D are top views of the second deflection electrode plate produced by the third production method according to the fourth embodiment.
Figure 19D:
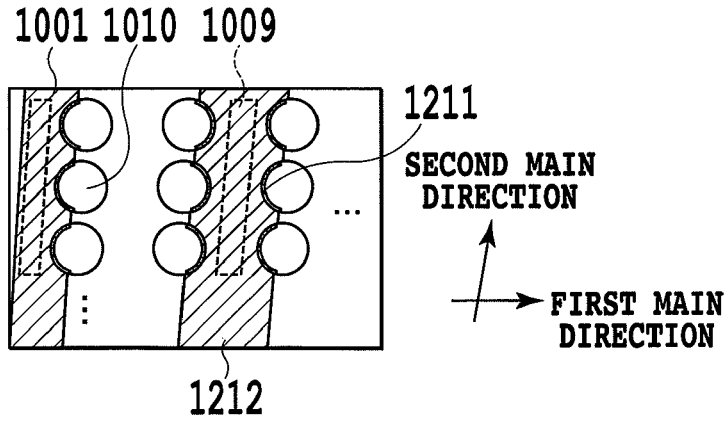

In the third production method, oblique evaporation is performed twice with changing an angle in order to form an electrode on both of two inner walls that face each other (see FIG. 18E). The third production method is largely different from the second production method in that, before the oblique evaporation, a mask needs to be preliminarily formed so as not to form a conductive layer on a portion other than the electrodes. The mask is formed by a method illustrated in FIG. 18A, and it is important that the mask has a shape that projects toward the ink flying path so as not to form a conductive layer on an inner wall even by the oblique evaporation. A thick film resist or the like with high rigidity is used for the mask. After forming the mask, an ink flying path and an ink recovery path are etched as illustrated in FIG. 18B. This enables the mask projecting toward the ink flying path to be formed. Also, in the case of using a film resist, a mask for the oblique evaporation can be formed after the ink recovery path is formed (after the illustration of FIG. 18B). Further, by removing the mask after the oblique evaporation, a conductive layer formed on the mask can also be removed. In the case where the conductive layer is formed on a side wall of the mask by the oblique evaporation and difficult to be removed, by selecting for the mask a film-like material that is flexible and hardly broken, and has high peeling property, such as parylene, the mask can be peeled off not by dissolution with the use of a solvent but by peeling off.

Figure 20B:
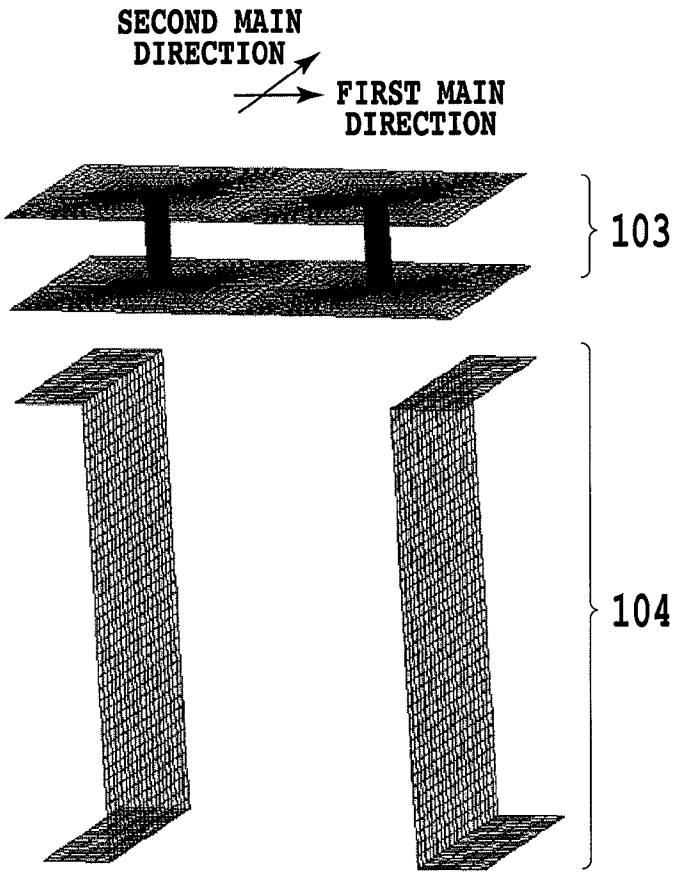
FIG. 20B is a diagram illustrating a model of the electric field simulation in the deflection electrode plate according to the fourth embodiment.
Figure 20A:
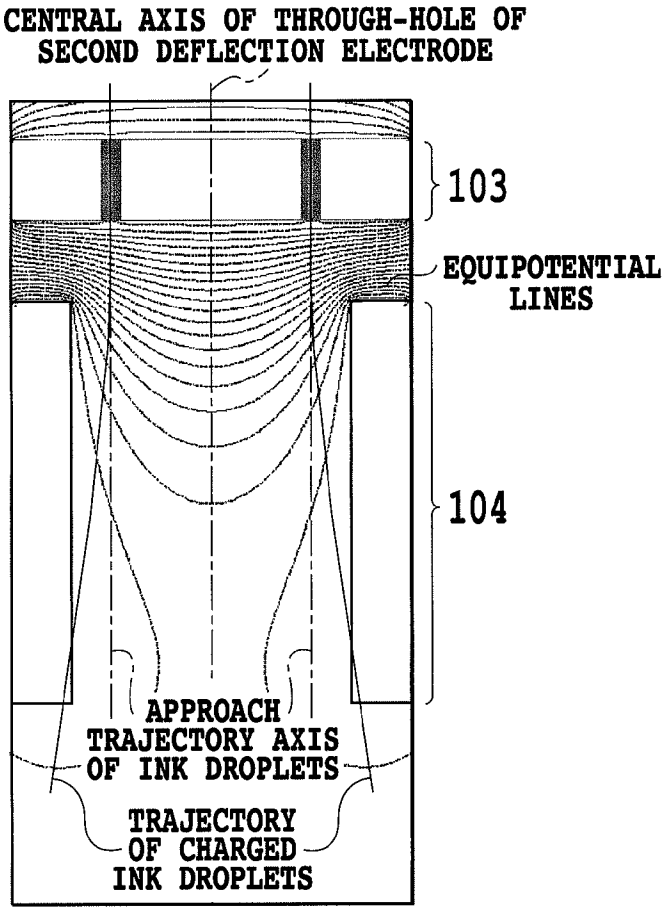
FIG. 20A is a diagram illustrating a result of an electric field simulation in the deflection electrode plate according to the fourth embodiment.

FIG. 20A illustrates a simulation result of equipotential lines of an electric field in the deflection electrode and a trajectory of charged ink droplets under the same driving conditions as those of the first embodiment. The three-dimensional nonlinear static electric field analysis software ELFIN (Elf Corporation) was used for this simulation. FIG. 20B illustrates a perspective view of a structure model used for the simulation. Charged ink droplets are deflected by 100 μm at the position of 860 μm above the top end of the second deflection electrode plate 104. Therefore, a deflection amount is obtained greater than that in the configuration of the first embodiment.

For comparison, returning to the equipotential lines in the simulation result (see FIG. 10A) of the first embodiment, in the configuration according to the first embodiment, a conductive surface of the second deflection electrode plate 104 with respect to an adjacent nozzle functions as a shield that blocks an electric field, and as a result an electric field from the first deflection electrode plate 103 hardly reaches an inside of the ink flying path (through-hole) of the second deflection electrode plate 104.

On the other hand, in the configuration of the present embodiment, conductive surfaces of inner walls of the second deflection electrode plates 104 are placed so as to face each other with being sandwiched between adjacent trajectories of ink droplets. That is, the conductive surfaces of the second deflection electrode plates 104 that face each other in the first main direction are configured to define ink flying paths with sandwiching approach trajectory axis lines of ink droplets from two adjacent nozzles between the conductive surfaces. For this reason, a distance between conductive surfaces of inner walls of the second deflection electrode plate 104 is widened, and as a result, an electric field generated between them and the first deflection electrode plate 103 goes inside an ink flying path of the second deflection electrode plate 104. On the basis of this, charged flying ink droplets are subjected to an effect of an electric field in a longer time period and thereby receive greater deflection. According to the simulation, a shape of the electric field is almost mirror-symmetrical with respect to a central axis line between two conductive surfaces of inner walls of the second deflection electrode plate 104 that face each other. Electric flux lines are vertical to illustrated equipotential lines, and therefore, when negatively-charged ink droplets approach from right toward this central axis line, they are deflected rightward, whereas when they approach from left, they are deflected to positive (if a polar character of a charging electrode or a polar character of the deflection electrode is reversed, deflection is performed in a reverse direction). In the present embodiment, an approach trajectory axis line of ink droplets from the left nozzle toward a through-hole of the deflection electrode shifts leftward by 250 μm from the central axis line in the first main direction, whereas an approach trajectory axis line of ink droplets from the right nozzle toward the through-hole of the deflection electrode shifts rightward by 250 μm from the central axis line. Therefore, the charged ink droplets from the left nozzle is subjected to electrostatic force so as to be deflected leftward, whereas the charged ink droplets from the right nozzle is subjected to electrostatic force so as to be deflected rightward, resulting in the trajectories illustrated in FIG. 20A.

The second deflection electrode plate 104 produced by the third method according to the present embodiment has an insulating portion between adjacent trajectories of ink droplets. Since this insulating portion does not function as an electric shield, an electric field generated between the first deflection electrode plate 103 and the second deflection electrode plate 104 is the same as that illustrated in FIG. 20A. Especially, in this configuration, since aerodynamic interference between ink droplets ejected from adjacent nozzles can be prevented due to this insulation wall to stabilize flying of ink droplets, and thereby accurate printing can be performed.

According to this simulation, the charged ink droplets hit against the second deflection electrode plate 104, and after the hitting, they go along the electrode plate and are finally recovered by the gutter 005 below (not illustrated). As with the third embodiment, the second deflection electrode plate 104 may be made of a porous material and made to function also as the gutter. Alternatively, a charge voltage or a deflection voltage may be reduced or a thickness of the second deflection electrode plate 104 may be reduced so that charged ink droplets do not hit against the second deflection electrode plate 104 but directly hit the gutter portion. If the charge voltage or deflection voltage is reduced, power consumption can be reduced, which is an advantage, whereas if the thickness of the second deflection electrode plate 104 is reduced, a distance between a nozzle and a medium to be printed can be reduced, resulting in an increase in printing accuracy, which is also an advantage.

On the other hand, uncharged ink droplets are not deflected, fly linearly, and land on a print medium below.

Fifth Embodiment

Figure 22:
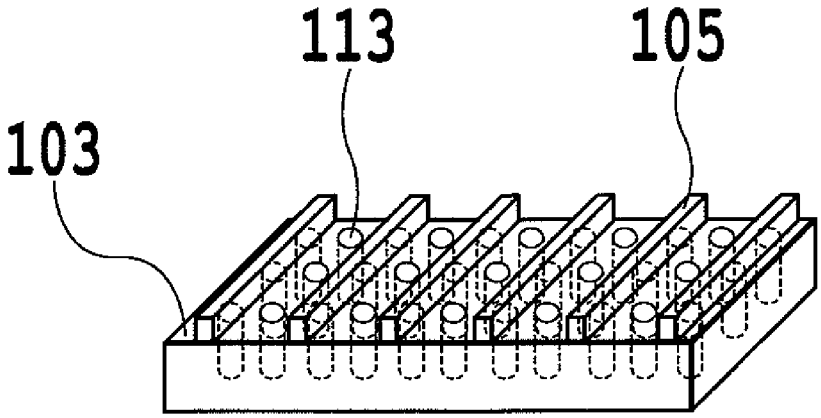
FIG. 22 is a perspective view illustrating a first deflection electrode according to the fifth embodiment.

A fifth embodiment of the present invention will be described. FIG. 21 illustrates a cross-sectional view of a side surface of an inkjet head according to the present embodiment. FIG. 22 illustrates a perspective view (turned upside down and seen from below) of the first deflection electrode plate 103 according to the present embodiment. In the present embodiment, configurations of members other than the first deflection electrode plate 103 are the same as those of the fourth embodiment.

In the present embodiment, the first deflection electrode is provided with projections 105 that project toward through-holes of the second deflection electrode plate 104. The projections 105 are placed so as to sandwich a flying trajectory of ink droplets with respect to two electrodes that are on inner walls of the through-holes of the second deflection electrode plate 104 and face each other in a first main direction, but do not go into the through-holes of the second deflection electrode.

Figure 23A:
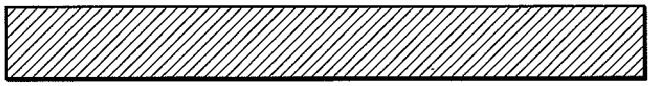
FIGS. 23A and 23B are process diagrams of the first deflection electrode by a first production method according to the fifth embodiment.
Figure 23B:
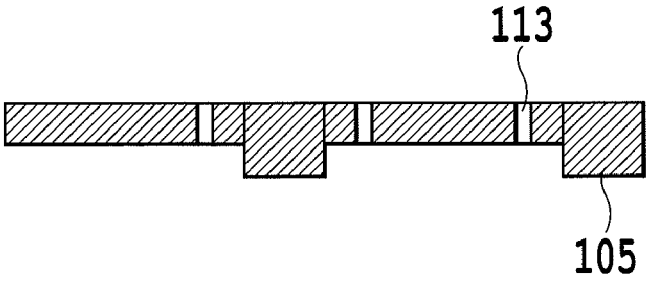

A first production method for the first deflection electrode plate 103 according to the present embodiment will be described. A conductive member with corrosion resistance, such as stainless steel, is used for a substrate as illustrated in FIG. 23A. In the present embodiment, a substrate has a thickness set to 400 μm. As illustrated in FIG. 23B, the through-hole that ink passes through and the projection are formed. In the present embodiment, the through-hole is configured to have a tubular shape and a hole diameter of 50 μm, as illustrated in FIG. 22. The projection is configured to have a straight-beam shape, a width of 300 μm, and a height of 200 μm. The through-hole and projection can be formed by etching or press processing. Further, gold plating may be applied to an electrode plate surface in order to increase conductivity and corrosion resistance.

Figure 23C:
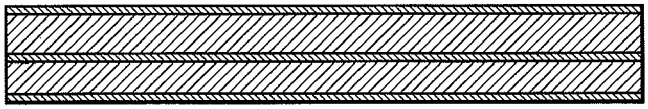
FIGS. 23C to 23E are process diagrams of the first deflection electrode by a second production method according to the fifth embodiment.
Figure 23D:
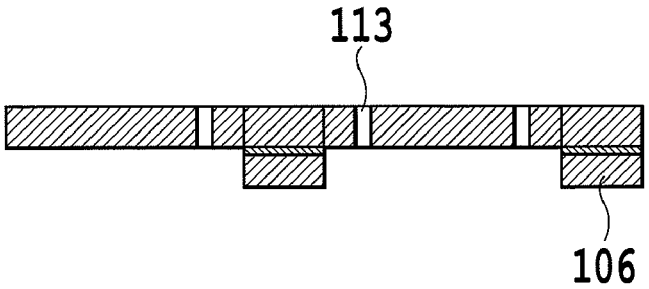
Figure 23E:
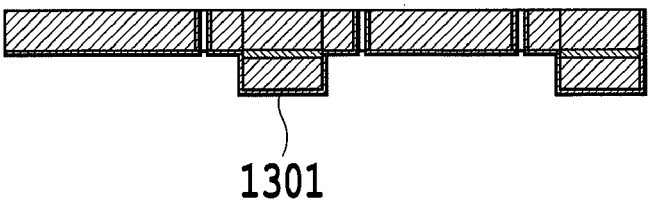

Next, a second method for producing the first deflection electrode plate 103 according to the present embodiment will be described. An SOI (silicon on insulator) wafer is used for a substrate. In the present embodiment, a handle layer has a thickness of 200 μm, a BOX layer has a thickness of 1 μm, and a device layer has a thickness of 200 μm. First, the substrate is thermally oxidized to form a silicon oxide layer on its surface (see FIG. 23C). Then, the formed oxide layer is patterned by photolithography. Each of front and back surfaces is etched by ICP-RIE with the use of the patterned oxide layer as a mask to form a through-hole (ink flying path) 113 and the projection 105. Further, the silicon oxide on the front surface and ink flying path is removed by hydrogen fluoride (see FIG. 23D). Subsequently, a metal film that becomes an electrode is deposited from the back surface (see FIG. 23E). A metal thin film with corrosion resistance, such as Au, is suitable for the electrode. In order to increase adhesion to the substrate, it is better to deposit a thin film of Ti or the like as a base layer. Regarding the deposition, a method that can also easily form a film on an inner wall, such as sputtering, is suitable.

Figure 24B:
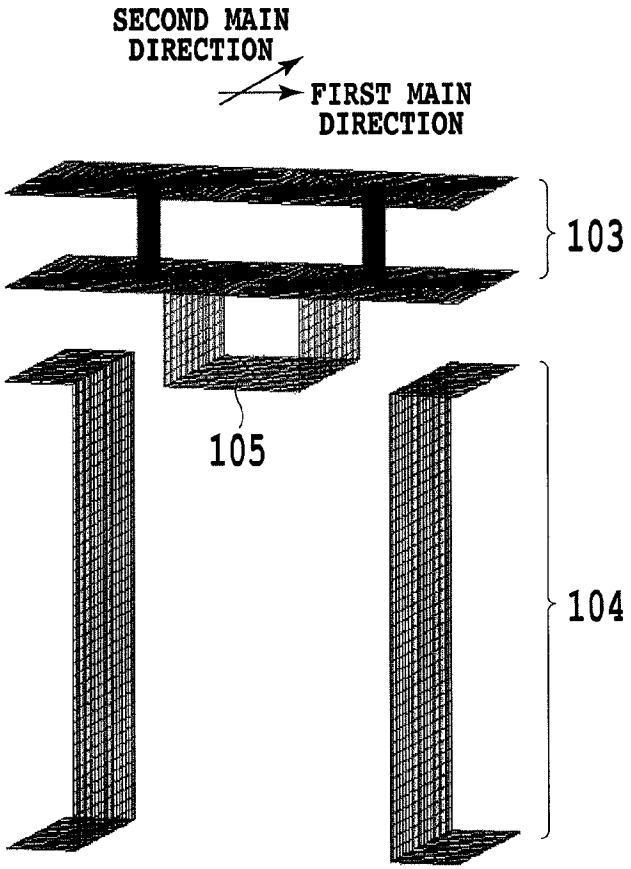
FIG. 24B is a diagram illustrating a model of the electric field simulation in the deflection electrode plate according to the fifth embodiment.
Figure 24A:
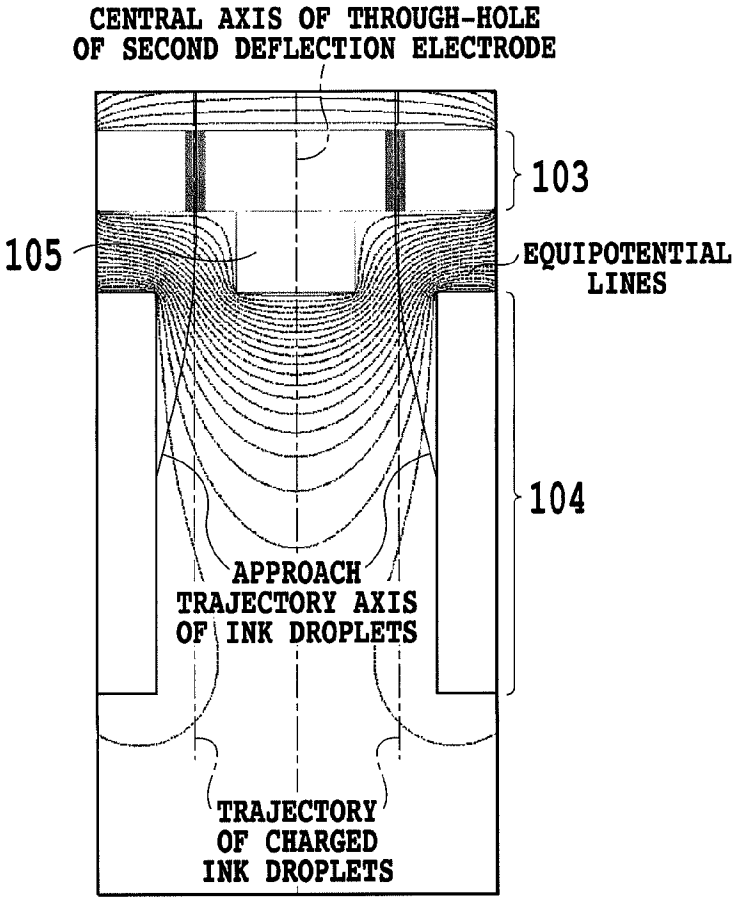
FIG. 24A is a diagram illustrating a result of an electric field simulation in the deflection electrode plate according to the fifth embodiment.

FIG. 24A illustrates a simulation result of equipotential lines of an electric field in the deflection electrode and a trajectory of charged ink droplets under the same driving conditions as those of the first embodiment. The three-dimensional nonlinear static electric field analysis software ELFIN (Elf Corporation) was used for this simulation. FIG. 24B illustrates a perspective view of a structure model used in the simulation. Charged ink droplets are deflected by 100 μm in the first main direction at the position of 470 μm from the top end of the second deflection electrode. Therefore, a deflection amount can be obtained greater than those in the configurations of the first and fourth embodiments. This may have several causes. As compared with the simulation result of the fourth embodiment (see FIG. 20A), first, it can be seen that an electric field generated between an inner wall of the projection and the second deflection electrode is closely vertical to a flying direction of the ink droplets. Also, a distance between the electrodes becomes shorter due to the projection, and a density of the equipotential lines between the electrodes becomes higher. Further, the equipotential lines can go into a deeper portion of a through-hole of the second deflection electrode plate 104. Due to these causes, charged ink droplets are deflected greater as compared with other embodiments.

In the present embodiment, if the second deflection electrode plate 104 is produced by the same method as that of the fourth embodiment, the second deflection electrode plate 104 produced by the third production method has an insulating portion between trajectories of ink droplets. Since this member does not function as an electric shield, an electric field generated between the first deflection electrode plate 103 and the second deflection electrode plate 104 is the same as that illustrated in FIG. 24A. In this case, the projection 105 is disposed with facing this insulating member. Especially, by using this configuration, aerodynamic interference between ink droplets ejected from adjacent nozzles can be prevented due to this insulation wall to thereby stabilize flying of ink droplets, and therefore accurate printing can be performed.

According to this simulation, charged ink droplets hit against the second deflection electrode plate 104, and after the hitting, they go along the electrode plate, and finally are recovered by the gutter 005 below (not illustrated). As with the third embodiment, the second deflection electrode plate 104 may be made of a porous material and made to function also as the gutter. Alternatively, a charge voltage or deflection voltage may be reduced or a thickness of the second deflection electrode plate 104 may be reduced so that charged ink droplets do not hit against the second deflection electrode plate 104 but directly hit the gutter portion. If the charge voltage or deflection voltage is reduced, power consumption can be reduced, which is an advantage. Also, if the thickness of the second deflection electrode plate 104 is reduced, a distance between a nozzle and a medium to be printed can be reduced to increase printing accuracy, which is also an advantage. On the other hand, uncharged ink droplets are not deflected, fly linearly, and land on a print medium below.

As described above, it can be seen that, by providing the first deflection electrode plate 103 with the projection 105, charged ink droplets can be more efficiently deflected. Further, since this projection does not go into a through-hole of the second deflection electrode, high accuracy is not required for assembling of an inkjet head because of this projection.

Since a liquid ejection head according to the present invention has nozzles in a two-dimensional array, it can be utilized to realize a high-speed and high-accurate liquid ejection device. Also, in a method for producing the liquid ejection head according to the present invention, layered deflection electrode plates can be laminated to produce a head corresponding to multiple nozzles, and therefore, the method can be utilized to produce a low cost liquid ejection head having a smaller number of components.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-092088, filed Apr. 13, 2010, which is hereby incorporated by reference herein in its entirety.

What is claimed is:

1. A liquid ejection head comprising:

a nozzle member having a plurality of nozzles to eject ink droplets, the plurality of nozzles being arranged in a two dimensional manner along a first direction and a second direction different from the first direction;

a charging member having a charging electrode to charge ink droplets ejected from each of the plurality of nozzles; and a first deflection member and a second deflection member, each having a deflection electrode to deflect each of the ink droplets charged by the charging electrode, wherein each of the charging member, the first deflection member, and the second deflection member have through-holes that the ink droplets ejected from the plurality of nozzles pass through, the charging member, the first deflection member, and the second deflection member are laminated in this order in a direction in which the ink droplets are ejected from each of the plurality of nozzles, and the first deflection member includes a projection portion that projects toward each of the through-holes of the second deflection member and a conductive surface comprising the deflection electrode.

2. The liquid ejection head according to claim 1, wherein the second deflection member is formed of a porous body that can absorb the ink droplets.

3. The liquid ejection head according to claim 1, wherein the second deflection member has a conductive surface on an inner wall of each of the through-holes, each conductive surface corresponding to one of the plurality of nozzles, and the conductive surfaces of the second deflection member define an ink droplet flying path so as to sandwich two approach trajectory axis lines of ink droplets from two adjacent nozzles between the conductive surfaces, the conductive surfaces facing each other in the first direction.

4. The liquid ejection head according to claim 3, wherein the projection portion is positioned so as to be sandwiched between the two approach trajectory axis lines of ink droplets from the two adjacent nozzles.

5. The liquid ejection head according to claim 1, wherein insulating members each having through-holes that the ink droplets pass through are interposed between the nozzle member and the charging member, between the charging member and the first deflection member, and between the first deflection member and an electrode plate of the second deflection member, respectively.

6. The liquid ejection head according to claim 1, wherein the charging member has the charging electrode formed on an inner wall of each of the through-holes thereof, and wiring drawn from the charging electrode, and each of the first and second deflection members has the deflection electrode formed on an inner wall of each of the through-holes, and wiring electrically connecting the respective deflection electrodes.

7. The liquid ejection head according to claim 1, wherein the deflection electrodes of the first deflection member are connected to each other so as to have a same electrical potential, and the deflection electrodes of the second deflection member are connected to each other so as to have a same electrical potential.

* * * * *